US007320507B2

(12) United States Patent
White et al.

(10) Patent No.: US 7,320,507 B2
(45) Date of Patent: Jan. 22, 2008

(54) REAR INTERLOCK

(75) Inventors: David Martin White, Northampton (GB); Kurt Scherrer, Muensingen (CH); Alexander Schaerer, Guemligen (CH)

(73) Assignees: Accuride International Limited, Northampton (GB); USM Holding AG, Guenligen (CH)

( * ) Notice: Subject to any disclaimer, the term of this patent is extended or adjusted under 35 U.S.C. 154(b) by 378 days.

(21) Appl. No.: 10/491,845

(22) PCT Filed: Oct. 4, 2002

(86) PCT No.: PCT/GB02/04502

§ 371 (c)(1),
(2), (4) Date: Oct. 6, 2004

(87) PCT Pub. No.: WO03/031753

PCT Pub. Date: Apr. 17, 2003

(65) Prior Publication Data

US 2005/0040739 A1 Feb. 24, 2005

(30) Foreign Application Priority Data

Oct. 5, 2001 (GB) ..... 0124039.9

(51) Int. Cl.
*E05B 65/46* (2006.01)

(52) U.S. Cl. ..... 312/221; 312/217

(58) Field of Classification Search ..... 312/216, 312/217, 218, 220, 221, 222, 107.5
See application file for complete search history.

(56) References Cited

U.S. PATENT DOCUMENTS 2,719,770 A 10/1955 Roberts
3,874,755 A 4/1975 Hegg et al.
3,881,793 A 5/1975 Anderson
3,900,236 A 8/1975 Goulish et al.
4,480,883 A 11/1984 Young
5,040,858 A 8/1991 Kruse et al.
5,050,942 A 9/1991 Frederick et al.

(Continued)

FOREIGN PATENT DOCUMENTS

EP 0302 979 2/1989

(Continued)

*Primary Examiner*—James O. Hansen
(74) *Attorney, Agent, or Firm*—Stephen B. Salai, Esq.; Michael J. Didas, Esq.; Harter Secrest & Emery LLP

(57) ABSTRACT

An interlock for a stack of drawers. A pair of drawer slides mounts each drawer, the interlock assembly being fitted to the rear of one of the drawer slides. A housing has a plate slidably supported thereon biased towards the rear of the slide. An actuator having an actuating surface co-operates with an actuator follower slidably supported in the slide member for movement at right angles to the movement of the plate. Releasable latching means extends between the housing and plate. Releasable catching means extend between the plate and the actuator. When a drawer is moved towards an open position, the catching means causes the plate to move to a blocking position where it can be held by the latching means, causing the actuating surface to co-operate with a follower surface on the actuator follower to move the actuator follower from a first position to a blocking position.

37 Claims, 12 Drawing Sheets

U.S. PATENT DOCUMENTS

| | | | | |
|---|---|---|---|---|
| 5,207,781 | A | 5/1993 | Röck | |
| 5,333,949 | A * | 8/1994 | McGregor | 312/221 |
| 5,352,030 | A | 10/1994 | Derle et al. | |
| 5,988,778 | A * | 11/1999 | Lammens | 312/217 |
| 6,238,024 | B1 * | 5/2001 | Sawatzky | 312/221 |
| 6,254,205 | B1 | 7/2001 | Wright et al. | |

FOREIGN PATENT DOCUMENTS

| | | |
|---|---|---|
| EP | 0391 221 | 10/1990 |
| EP | 0 818 597 A2 | 1/1998 |

* cited by examiner

REAR INTERLOCK

This invention relates to an interlock assembly for a drawer slide. In particular, this invention relates to an interlock assembly that is positioned at the rear end of a drawer slide. In addition, this invention relates to an interlock assembly for use with a set of vertically arranged drawers to prevent a drawer in the set of drawers from being opened while any other drawer in the set is open.

The invention also extends to an interlock assembly provided with a self close mechanism for the drawer slide to which it is fitted.

Items of furniture comprising drawers frequently have drawers, each of which is mounted in a frame by means of a pair of slides. Such slides comprise at least two slide members, which extend longitudinally and are slidable relative to one another. One slide member, usually the inner member, is attached to the drawer and the other slide member, usually the outer member, is attached to the frame of the item in which the drawer is mounted. Often there is at least one intermediate slide member positioned between the outer and inner slide members. Usually, the slide members are slidably connected in that a bearing raceway of one slide member nests within and interlinks with a bearing raceway of at least one other slide member using ball bearings. The slide assembly helps to reduce friction between the drawer and the frame and, consequently, makes movement of the drawer easier and reduces wear on the components.

Where an item of furniture comprises more than one drawer, there is a risk that the item of furniture may tilt or topple over if more than one drawer is open at any one time. Therefore, it is desirable to include in the furniture an interlock, that is, a means for allowing a drawer to be opened only if no other drawer in the set of drawers is open, thereby preventing more than one drawer from being opened at any one time. Means for providing an interlock between drawers vertically arranged in a frame have been disclosed in the prior art. EP 0 818 597 A2 discloses an interlock assembly for use with two or more vertically arranged drawers mounted on drawer slides. The interlock assembly is arranged at the front of the drawer slide, that is, at the end nearest the drawer front. When a drawer is opened, actuator followers mounted in the outer or fixed slide member are pushed out from their position in the outer slide member by an actuator and are kept in this position by the side edge of the inner slide member. The actuator followers are each attached to rods and the movement of the actuator followers causes these rods to be pushed away from the slide, up and down, respectively. At the other end of each rod there may be an additional actuator follower. The movement of the rod pushes the additional actuator follower against the actuator of the inner slide member of the drawer immediately below and/or immediately above the drawer that has been opened. Accordingly, the actuator followers prevent the actuator on the front end of the inner slide member from sliding relative to the outer or fixed slide member when another drawer is open. In this way the movement of the rods and actuators is transmitted to the drawers above and below the drawer which is open so that all other drawers are prevented from opening by the action of at least one actuator follower against the actuator for each drawer.

However, where an interlock assembly is situated at the front end of a drawer slide, the rods or other means for connecting the interlock assembly of the drawer slide to the interlock assemblies of a drawer slide above and/or below the drawer prevents a cover or shroud from being positioned around the drawer slide. Such covers are desirable for aesthetic reasons and consequently there is a need for an interlock assembly which will allow shrouds to cover the drawer slides.

Simply reversing the interlock assemblies of the prior art would not solve this problem because, when the inner slide member moves relative to the outer slide member, the actuator moves away from the rear end of the drawer slide and passes the actuator followers. Once the actuator has passed the actuator followers, there is nothing to keep the actuator followers away from their original position in the outer slide member. Thus, other drawers in the vertical arrangement of drawer slides may be opened.

The present invention aims to provide an interlock assembly which overcomes the above problems.

According to the present invention there is provided a drawer slide interlock assembly for a drawer cabinet comprising a set of vertically arranged drawers mounted in a frame by spaced drawer slides each having an outer slide member and an inner slide member slidable relative to one another, the outer slide members being adapted for mounting on the frame and the inner slide members being adapted for mounting on respective ones of the drawers, wherein said interlock assembly is located at the rear of the extendible drawer slides, and comprises, for each drawer slide on at least one side of the set of drawers, a drawer slide interlock assembly for a drawer cabinet comprising a set of vertically arranged drawers mounted in a frame by spaced drawer slides each having an outer slide member and an inner slide member slidable relative to one another, the outer slide member being adapted for mounting on the frame and the inner slide member being adapted for mounting on a respective one of the drawers, wherein said interlock assembly is located at the rear of the extendible drawer slides, and comprises, for each drawer slide on at least one side of the set of drawers, a plate movable relative to the outer slide member between a first position and a blocking position, an actuator mounted on the rear of the inner slide member, catching means enabling the plate to be engaged by the actuator to move it to its blocking position when the drawer to which the inner slide member is connected is opened, means for maintaining the plate in the blocking position in the housing, an actuator follower supported for movement relative to the outer slide member between a plate blocking position and a blocked position and wherein, when the drawer is opened, the actuator follower will be moved from its plate blocking position to its blocked position, said actuator follower subsequently being maintained in said blocked position while the drawer is open, and wherein closing of the drawer will cause the plate to be returned to its first position, and the actuator follower will be allowed to return to its plate blocking position.

In the preferred arrangement, the actuator co-operates with the actuator follower to move the actuator follower outwardly away from the longitudinal central axis of the outer slide member. However, co-operation could be between the plate and the actuator follower. In either of these arrangements, it is preferred that the actuator follower is maintained in said blocked position as a result of the plate being held in its blocking position as a result of moving to a latched position. Hence, when unlatching occurs, this will allow the actuator follower to return to its plate blocking position, because both the plate and the actuator will have returned to a "drawer-closed" position. Instead of being slidably mounted, the or each actuator follower could be mounted for rotary movement relative to the outer slide member.

Although the plate could be mounted for sliding movement directly in the outer slide member, e.g. on a suitable rail, it is preferred that the plate is slidably supported in a housing supported with a rear end of the outer slide member for movement parallel to said longitudinal central axis, said first position being at the rear of the housing, and the blocking position being spaced therefrom. Preferably also, latching means are provided between the housing and the plate.

Preferably, the drawer slide interlock assembly further comprises spring means biasing the plate towards the rear of the housing, the latching means extends between the housing and the plate to hold the plate in its blocking position spaced from the rear of the housing, and the catching means extends between the actuator and the plate, the catching means being arranged to move the plate from the rear of the housing to its blocking position when the inner drawer slide member is initially moved from its rearmost position when the drawer to which it is fitted is opened but being arranged to release the plate when the plate is in its blocking position to allow the drawer fully to open, said release occurring once the releasable latching means is in a latched position, the arrangement being such that when the drawer is moved towards a closed position and the actuator moves into the vicinity of the latched plate, the releasable latching means will be unlatched, thus allowing the plate to move under its spring bias to the rear of the housing, and wherein the actuator follower has at least one follower surface thereon co-operating with a surface on the actuator to move the actuator follower to its blocked position, there being to a connecting rod attached to the actuator follower at one end and attached to a similar actuator follower of a drawer slide interlock assembly of an adjacent drawer at its opposite end, the arrangement being such that, when the plate is in its blocking position, a side surface of the plate will prevent the actuator follower from moving back towards its plate blocking position, thus maintaining the actuator follower of the adjacent drawer slide interlock assembly of the adjacent drawer in such a position that it will prevent movement of the plate of the adjacent mechanism from moving to its blocking position, thereby preventing opening of the second drawer.

In one embodiment, the plate is delta-shaped with a forward projecting nose and the leading edges of the delta-shape provide actuating surfaces on the plate.

In another embodiment, the plate is U-shaped with leading edges thereof forming actuating surfaces on the plate.

The actuator follower may have two follower surfaces thereon, a first follower surface co-operating the actuator surface on the actuator and a second follower surface co-operating with a secondary actuating surface on the plate.

In one embodiment of the invention, the releasable latching means is formed partly on the projecting nose of the delta-shaped plate.

Preferably, the housing is divided into a rear part and a forward part spaced from the rear part and the rear part is connected to the forward part by at least one slide rail extending generally parallel to the longitudinal axis of the outer slide member.

Preferably also, a slideway is provided on the underside of the plate which engages with the or each slide rail of the housing.

It is preferred that a front edge of the rear part of the housing is parallel with a rear edge of the front part of the housing, said two edges providing guide walls or slide channels for the or each actuator follower.

In the first embodiment of the invention, two rails preferably extend the full length of the housing and the releasable latching means comprise an upstand at a forward end of one of the rails and a latching nose on a forward end of the plate.

In the first embodiment, a front end of the plate preferably has the latching nose and the plate catching means supported thereon, the latching nose being connected to the remainder of the plate by a thin section of plastics material acting as a pivot to allow the nose to pivot about an axis extending at right-angles to the plane of the plate.

Preferably, the nose has a hook on a rear face thereof which co-operates with a leading edge on the upstand to provide said releasable latching means. Preferably also, a rear face of the upstand co-operates with a stop on the plate to limit movement of the plate away from a rear end of the drawer slide.

In the first embodiment, the plate catching means preferably comprises a stud, which is preferably offset, on a rear face of the actuator which co-operates with a catching surface in a recess in the nose, the nose having a position of rest in which the hook is in a position to engage the forward end of the upstand and the arrangement being such that, when the actuator moves towards the rear of the outer drawer slide member so as to overlie the plate, the stud will engage with a release surface opposite the, catching surface to cause the nose to pivot in a direction so as to release the hook from the forward end of the upstand thus allowing the plate to move under its spring bias towards the rear of the outer drawer slide member until the side surface of the plate will no longer prevent the actuator follower from moving towards the longitudinal central axis of the slide member.

The actuating surface on the actuator preferably comes into contact with the first follower surface on the actuator follower before the actuating surface on the plate comes into contact with the second follower surface on the actuator follower. This ensures that movement of the actuator follower is started by the actuator. If such movement was started by the actuating surface on the plate, there is a risk that the resultant forces might unlatch the latching means as the inner drawer slide member was moved forwardly, or that the thin section of plastics material acting as a pivot for the latching nose might break.

It is important that the actuating surfaces make an acute angle with the longitudinal central axis; it is preferred that this angle be about 45°.

Preferably, the actuator has a further inclined surface on its trailing edge (relative to its forward movement) for co-operation with an inclined reset surface on the actuator follower. This is to allow the mechanism of the interlock assembly to be reset or recycled if, for some reason, it should fall out of synchronisation, e.g. as a result of accidental unlatching of the latching means, or inadvertent release of the catching means at the wrong time.

In a second embodiment of the invention, it is preferred that the rear part of the housing is connected to the forward part of the housing by a bridging member incorporating two outwardly turned rails with which a rear portion of the plate engages, there being upstanding guide posts located on a forward end of the forward part of the housing which act as guide means for a forward end of the plate.

In this embodiment, the forward end of the plate is preferably provided with laterally extending slide surfaces which engage beneath inturned guides on the upstanding guide posts and the forward end of the plate is provided with a central aperture therein to receive part of the catching means.

Preferably, the part of the catching means is pivotally supported within the aperture by means of a pair of outwardly projecting pivots which engage within mating pivot slots in the underside of the plate. Preferably also, the part of the catching means comprises a main spine which locates wholly within the aperture, the spine having upstanding from its rear end an abutment and upstanding from its front end a further abutment having a chamfered leading edge, there being a resiliently deformable latching hook extending from the underside thereof.

In the second embodiment of the invention, a groove is preferably formed on the rear face of the actuator which terminates in depending block sized to fit between the abutment and the further abutment, a rear face of the block being engageable with a forward face of the abutment and a front face of the block being engageable with a rear face of the further abutment, the arrangement being such that, as the actuator moves forwardly from a rear end of the outer drawer slide, the block will engage the rear face, thus drawing the plate against its spring bias towards a front end of the housing until a trailing end of the latching hook engages with a front edge of the forward part of the housing, whereupon the block will disengage from the catching means to allow the drawer to open fully, and the arrangement being such that, when the drawer is moved rearwardly, the rear face of the block will ride over the chamfered leading edge of the further abutment, allowing the actuator to move rearwardly until the block engages the forward face on the abutment, thus causing the catching means to pivot so as to disengage the hook from the front edge of the housing, allowing the block to engage between the abutment and the further abutment, and thereby allowing the plate to move under its spring bias towards the rear end of the slide member.

In a third, preferred embodiment of the invention, a single slide rail preferably joins together the front and rear parts of the housing and a central slide way is formed in said slide rail having at a rear end thereof a recycling recess and adjacent a front end thereof a latching recess. In this embodiment, it is preferred that the plate has a central slide way on its underside which engages with the slide rail and, preferably within the central slide way, a recess provided at one end with a pivot pin and at its opposite end with an arcuate slot whereby a pivoting arm having an aperture in one end thereof and a catch pin at the other end thereof is pivotally supported in the recess with the aperture surrounding the pivot pin and the catch pin sliding in the arcuate slot and projecting upwardly therefrom. Preferably also, a depending guide pin is provided on the underside of the pivot arm for sliding engagement in the slide way in the slide rail on the housing.

Preferably, the spring bias in the second and third embodiments is provided by a coil spring extending between a buffer at the rear of the housing and two spaced anchoring points on the underside of the plate.

In the preferred third embodiment of the invention, the actuator preferably has on its underside three principal recesses therein, two of which open laterally outwards and are partly defined by forwardly facing actuating surfaces designed to cooperate with follower surfaces on the actuator followers and the third of which is located between two rearwardly facing inclined surfaces designed to cooperate with forwardly facing inclined follower surfaces on the actuator followers. The third recess extends generally fore and aft within the underside of the actuator and has a downwardly depending island block therein spaced from the walls of the recess to define a fore and aft extending linear channel on one side of the block and a recycling channel on the other side. The fore and aft extending channel and the recycling channel are interconnected at a forward end of the recess by an arcuate wall of the recess, part of which defines an unlatching surface for the catch pin and another part of which forms a recycling camming surface for the catch pin. At its forward end, the island block has an inclined pin pulling surface which merges with a front end of a latch actuation surface, the rear end of which merges with the fore and aft extending passageway. At its rear end, the depending island block has a recycling surface leading into the recycling channel.

The arrangement is such that forward movement of the actuator will result in engagement of the catch pin by the pin pulling surface so as to move the plate towards a front end of the slide way in the slide rail of the housing until the depending guide pin on the underside of the pivoting arm is biased by the inclined pin pulling surface and thereafter the latch actuating surface into the latching recess in the slide way, whereupon the actuator will become disengaged from the plate allowing full opening of the drawer. By virtue of the pivotal attachment of the swinging arm on which the catch pin is supported to the plate, latching of the catch pin in the latching recess will result in the plate being moved to an actuator follower blocking position.

When the drawer is to be closed, the fore and aft extending passageway on the underside of the actuator will slide over the catch pin located in the latching recess until the unlatching surface forming part of the arcuate forward end of the recess in the underside of the actuator will cause unlatching of the catch pin from the latching recess thus allowing the plate to slide rearwardly preferably under the influence of its spring bias out of the actuator follower blocking position until the catch pin is at the rear end of the slide way in the slide rail of the housing. By this time, the pin will have become engaged between a central portion of the arcuate forward end of the recess and the pin pulling surface at the forward end of the depending island block, thus allowing the spring biasing the plate to its rearmost position in the housing to pull the inner slide member and the drawer attached thereto to its rearmost position, thus acting as a self-closing mechanism.

Should the plate inadvertently move to its rearmost position in the housing when the drawer is fully open due to the catch pin inadvertently becoming unlatched from the latching recess in the slide way, rearward movement of the actuator will result in a rearwardly facing recycling surface on the depending island block moving the catch pin upwardly into the recycling recess in the slide way to allow the island block to move past the pin whereupon the camming surface on the forwardly facing arcuate end of the recess in the underside of the actuator will move the catch pin back into its central location at the rear of the slide way.

The invention also extends to a drawer having a drawer slide interlock assembly as described above, and to a stack of drawers arranged vertically in a cabinet, each drawer being provided with an interlock assembly described above, there being a connecting rod extending between an actuator follower of the assembly of one drawer and that of an adjacent drawer, the rods being located adjacent the rear of the cabinet.

Also according to the invention, we provide a method of preventing a stack of drawers supported in a cabinet from toppling over as a result of more than one drawer being opened at any one time, comprising fitting each drawer in the stack with a drawer slide interlock assembly as described above, whereby when one of the drawers in the stack is opened, the interlock assembly will prevent the other drawers from being opened until the first drawer is moved to a closed position.

The drawer slide interlock assembly may have one or two actuator followers. Where a drawer slide interlock assembly is incorporated into a drawer slide that is located at the top or bottom of a set of vertically arranged drawer slides, the interlock assembly may have one actuator follower. Preferably, the drawer slide interlock assembly comprises two actuator followers slidably mounted in the outer slide member. Where there are two actuator followers, these are positioned on opposite sides of the longitudinal axis of the outer slide member.

Where the drawer slide interlock assembly is provided with two actuator followers, each actuator follower may have a half width leg portion, shaped to co-operate with and be alongside a half width leg portion of the second actuator follower, each half width leg portion being sufficiently long to extend beneath the slide rails of the housing to hold the actuator followers in position at all times.

Where the drawer slide has an intermediate slide member, the housing may include at least one stop to prevent the intermediate slide member from reaching the rear end of the outer slide member, and thus prevent it from interfering with the functioning of the drawer slide interlock assembly. Preferably, the rear end of the intermediate slide member has a central cut away portion such that there are two prongs which extend from the rear end of the intermediate slide member and each of which locate against a stop on the housing when the intermediate slide member is moved towards the rear of the housing.

The resilient means or spring biasing the plate towards the rear of the housing may also provide the drawer slide with a pull-in mechanism. By "pull-in mechanism" is meant a self-close mechanism that assists the final movement of the drawer slide towards the closed position. In a preferred embodiment of the present invention, as the inner slide member is pushed towards the rear of the drawer slide, the actuator overlaps the plate, which is held there by the catching means extending between the housing and the plate. When the inner slide member overlaps the plate, the catching means attaches the plate to the actuator. Consequently, the plate and actuator are pulled back together towards the rear of the drawer slide by the resilient means or spring extending between the housing and the plate.

Also according to the present invention, we provide an interlock assembly for a drawer slide of one of the drawers of a set of drawers mounted on drawer slides in a cabinet, the interlock assembly being provided at the rear of the drawer slide, said interlock assembly incorporating therein a self close mechanism for the drawer slide.

Preferably, the self close mechanism comprises a spring extending between a housing of the interlock assembly and a plate movably supported in the housing and which plate is connected to the inner slide member of the drawer slide by latching means forming part of the interlock assembly when the inner slide member is adjacent the rear of the drawer slide. Preferably, the plate is slidably supported in the housing between a first portion at the rear of the housing and a blocking position spaced therefrom, the spring biasing the plate towards the first position at the rear of the housing.

Three embodiments of the present invention are now described, by way of example only, with reference to the accompanying drawings in which.

Figure 4:
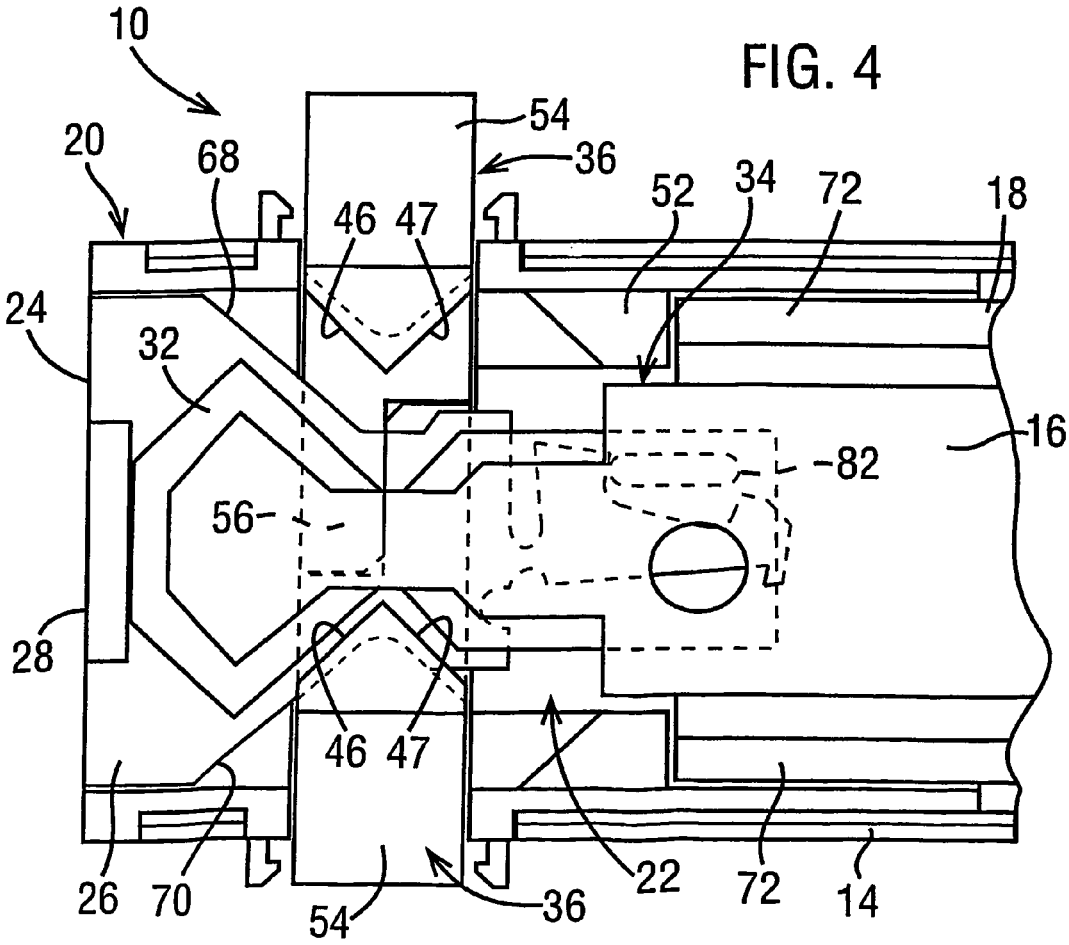
FIG. 4 is a plan view of a drawer slide interlock assembly showing two actuator followers in a plate blocking position and made up of the housing of FIG. 1, the plate of FIG. 2, two actuator followers of FIG. 3, all mounted on the rear of a drawer slide.
Figure 5:
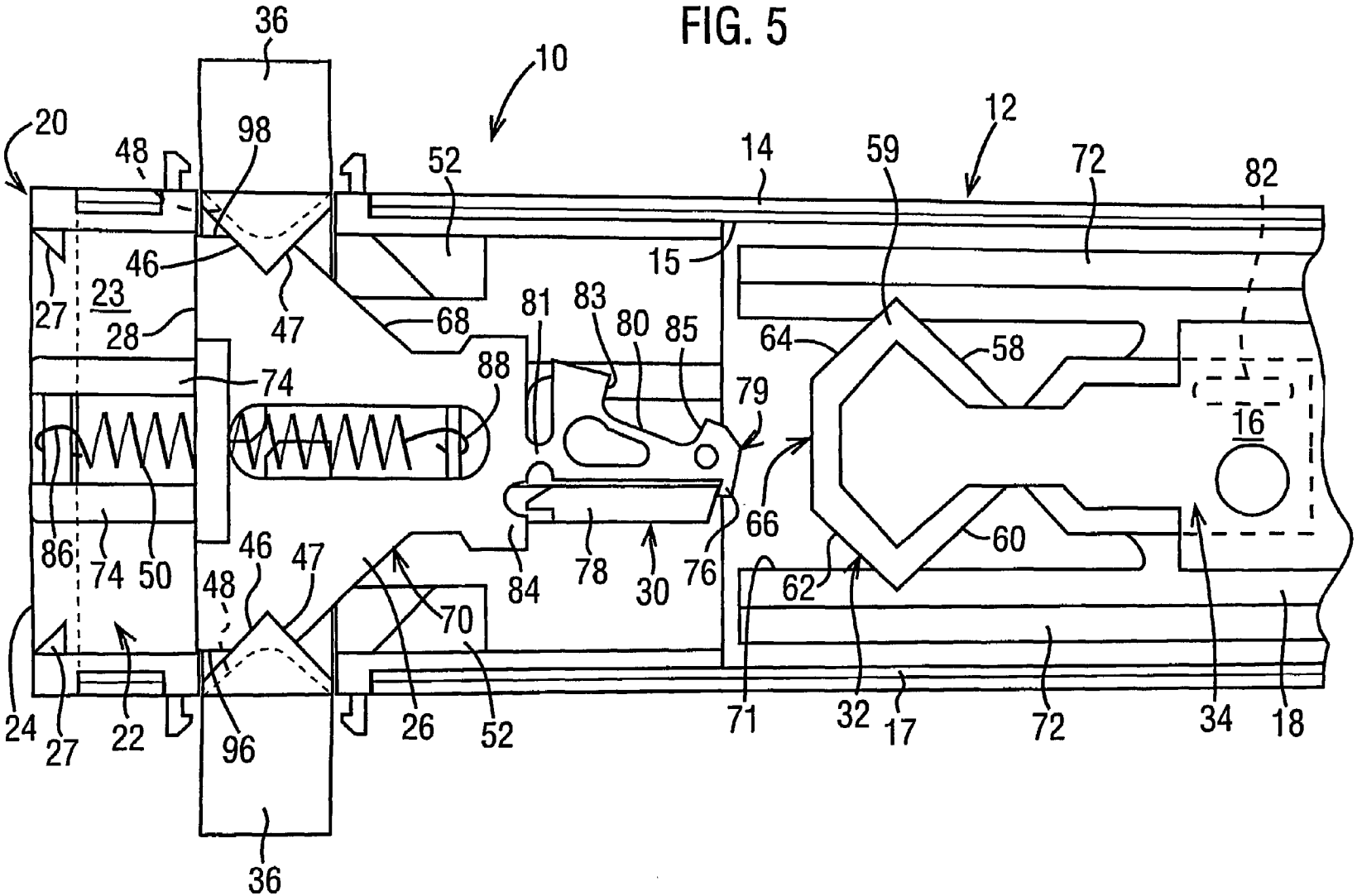
FIG. 5 is a plan view of the drawer slide interlock assembly of FIG. 1, with the drawer slide in a partially extended configuration and the plate in a latched, blocking position.
Figure 19:
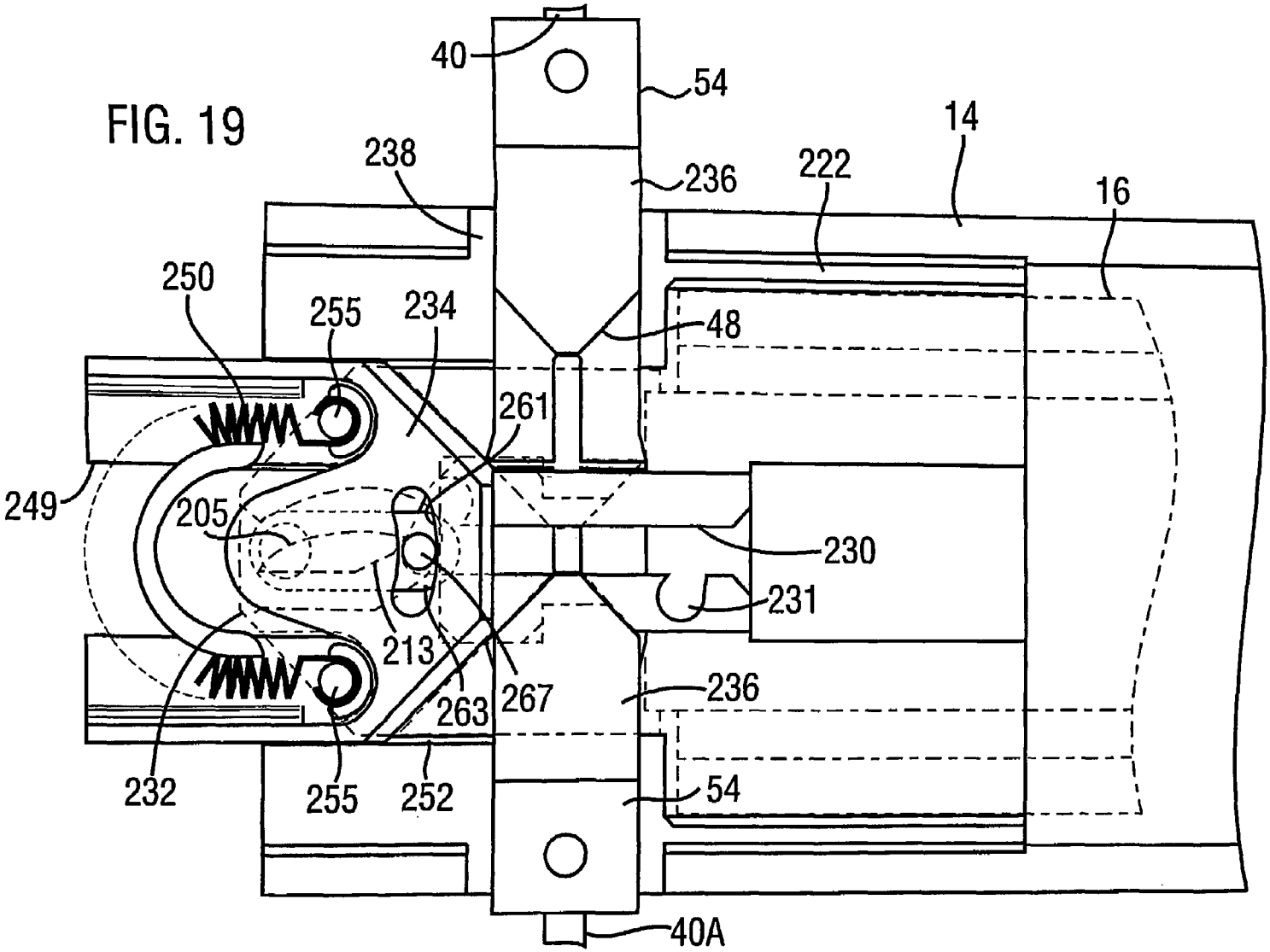
Figure 20:
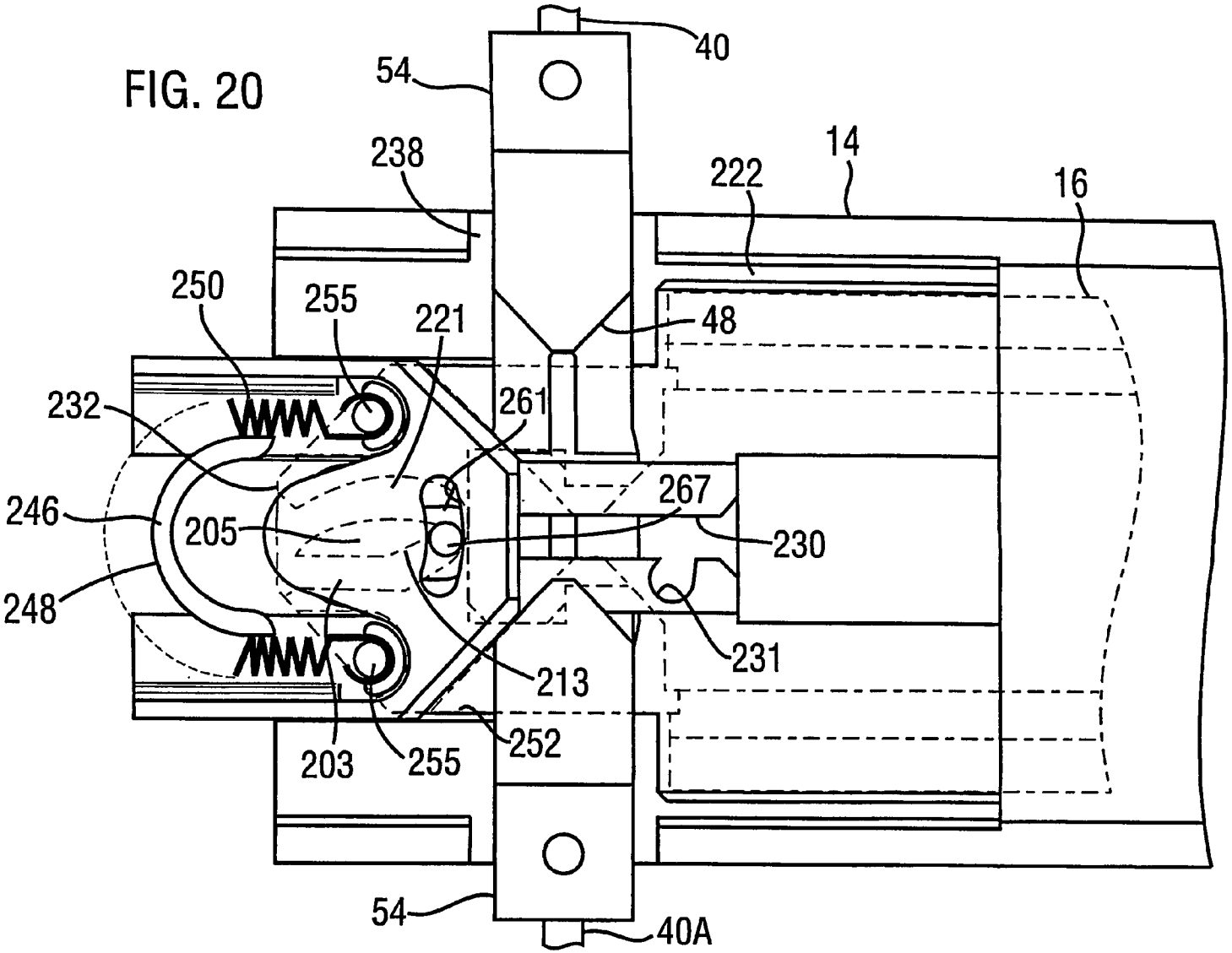
Figure 21:
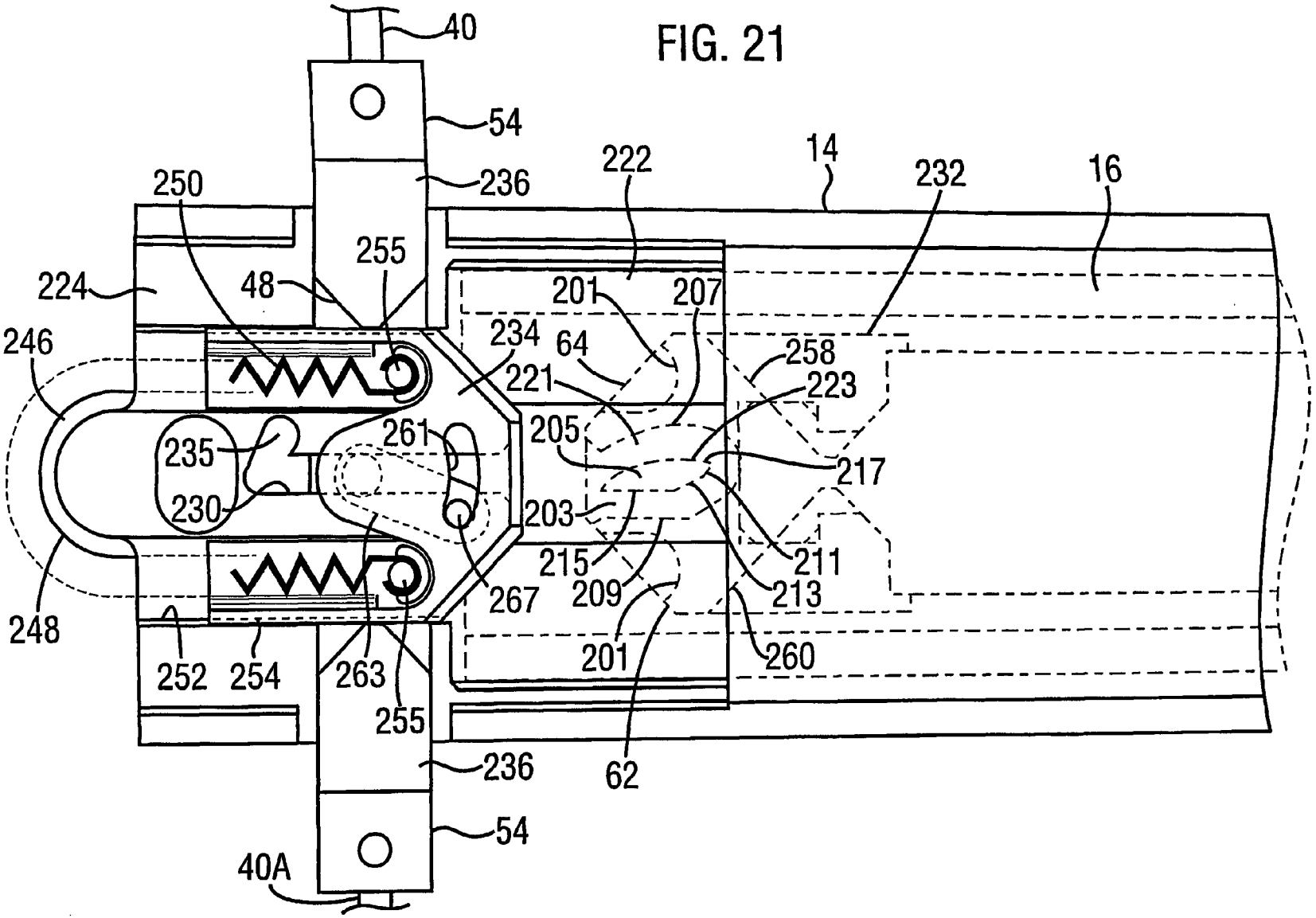

FIG. 19 is a plan view similar to FIG. 4, but of the third embodiment, showing the housing, plate and catching means and two actuator followers in a plate blocking position assembled in the rear of an outer slide member, with the plate biased to its rearmost position in the housing, and with an actuator connected to the rear end of an inner slide member shown in ghost in its position of use when a drawer to which it is fitted is in a closed position, and the actuator is overlying the plate and housing;

FIG. 20 is a view similar to FIG. 19, but showing the relative locations of the parts after the drawer has been opened a small amount; and FIG. 21 is a view similar to FIG. 5, but corresponding to FIGS. 19 and 20, and showing the relative positions of the parts when the drawer has been opened further, and the catching means has been moved to a latched position, in which the plate is in an actuator follower blocking position.

Referring to FIGS. 1 to 6 of the drawings, FIG. 5 shows a drawer slide interlock assembly (10) incorporated into the rear end (20) of a drawer slide (12). The drawer slide has an outer slide member (14), an inner slide member (16) and an intermediate slide member (18). The assembly (10) includes an actuator (32) mounted on the rear end (34) of the inner slide member (16). The actuator has two leading, inclined actuating surfaces (58, 60) and two further inclined surfaces (62, 64) on its trailing end (66) and a stud (82) located on the face of the actuator facing the outer slide member. As shown, the actuator is formed of a hard polymeric member (59) supported on the rear end (34) of the member (16).

Figure 1:
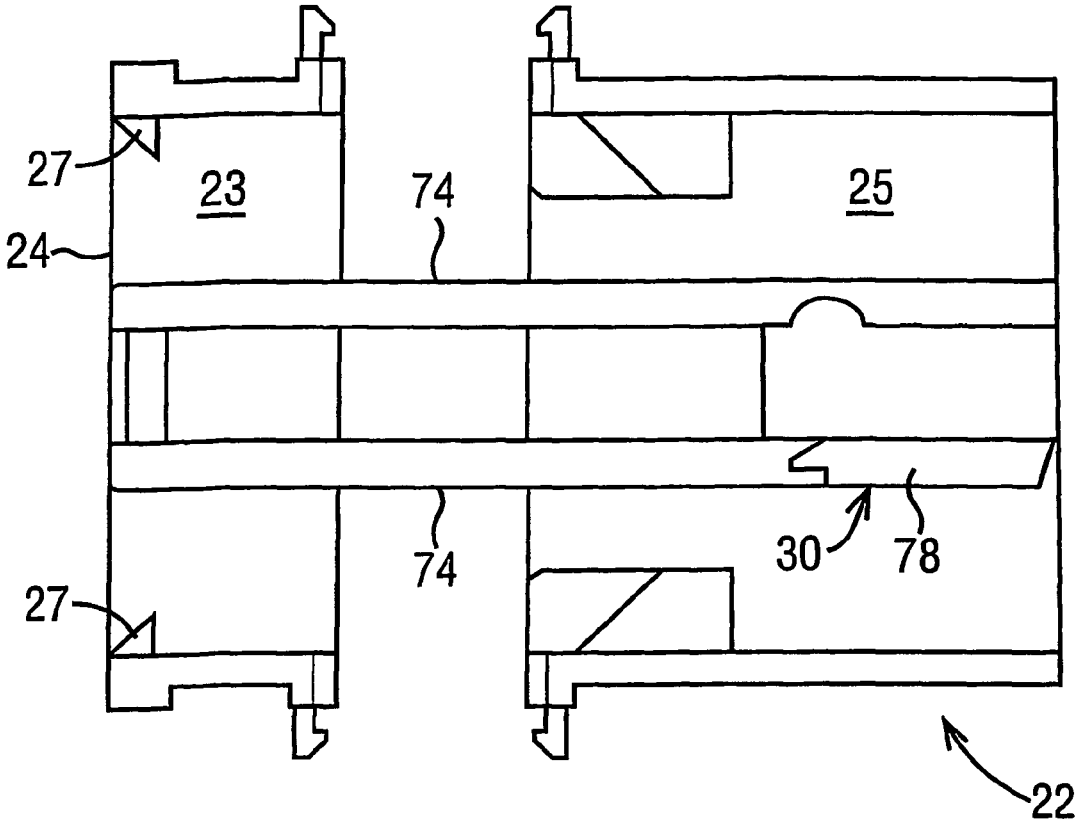
FIG. 1 is a plan view of a housing for incorporation in an outer slide member of a drawer slide according to a first embodiment of the invention.
Figure 2:
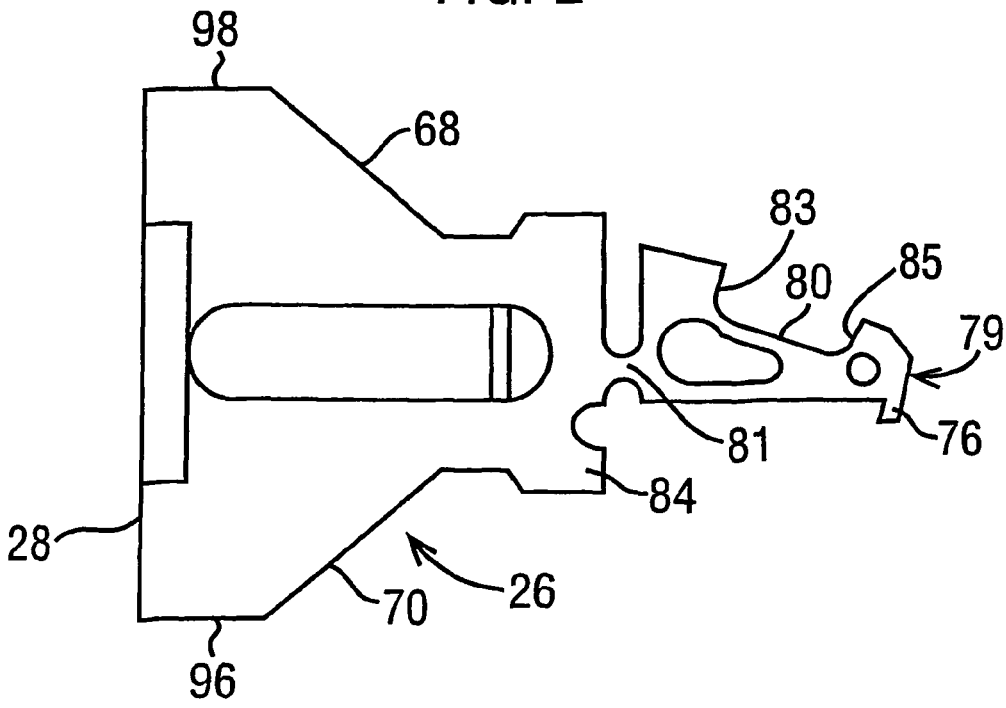
FIG. 2 is a plan view of a plate which is mountable on the housing of FIG. 1.
Figure 3:
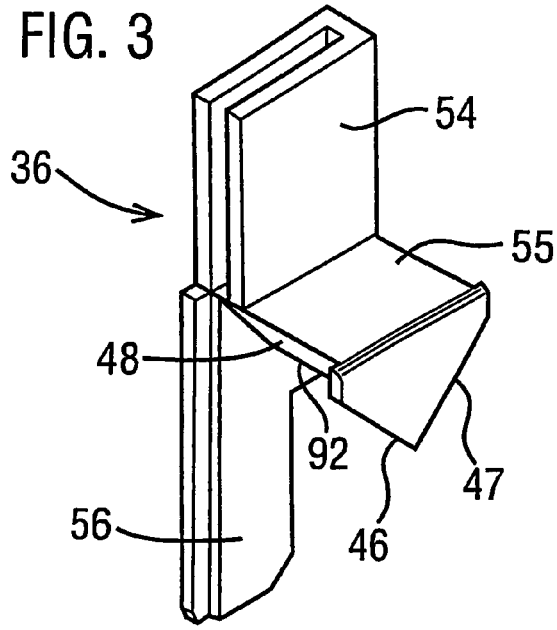
FIG. 3 is a perspective view of an actuator follower.

The assembly (10) includes a housing (22) which is mounted at the rear end of the outer slide member (14). The housing shown in detail in FIG. 1 is made from polymeric material and comprises a rear part (23) and spaced therefrom, a forward part (25) connected together by two upstanding, central rails (74) on which a delta-shaped plate (26), which is shown in FIG. 2, is slidably mounted. The plate (26) may slide between a rear edge (24) of the housing and a position spaced from the rear edge (26) with a spring (50) biasing the plate towards the rear edge (24). However, the spring (50) is not essential.

A catching means (30) extending between the housing (20) and the plate (26) holds the plate away from the rear edge (24) of the housing (22) and comprises an upstand (78) that is part of the housing and upstands from a front portion of one of the rails (74). The top surface of the upstand (78), when the plate (26) is assembled with the housing, as shown in FIGS. 4 and 5, lies substantially in the plane of the top of plate (26). The catching means further comprises a hook (76) and a stop (84) on the plate (26). One end (86) of the spring (50) is attached to the housing (22) and the other end (88) of the spring is attached to the plate (26). Two inwardly directed stops (27) form abutments on the housing (22) which limit rearward movement of the plate (26). Forward movement is limited by the stop (84) on the plate (26) co-operating with a rear face of the upstand (78).

On the underside of the plate (26), there are two grooves defined by inturned lower flanges and the underside of the plate itself which form a slideway and hold the plate captive on the rails (74), the rails having laterally outwardly extending flanges thereon beneath which the lower flanges on the underside of the plate engage.

The plate (26) has a rear edge (28), two inclined front edges which form secondary actuating surfaces (68 and 70), and two side edges (96 and 98) and a forwardly projecting nose (79) resiliently connected to a front end of the plate by a thin section of polymeric material (81) allowing the nose (79) to pivot about an axis extending at right angles to the plane of the plate (26). The hook (76) is formed on the nose (79). The plate fits between the slide tracks (15, 17) of the outer slide member. The plate (26) also has a recess (80) formed in a side face of the nose (79) which co-operates with the stud (82) on the actuator (32) to form an attaching means between the plate (26) and the actuator (32). The recess (80) has a release surface (83) and a catching surface (85).

Figure 6:
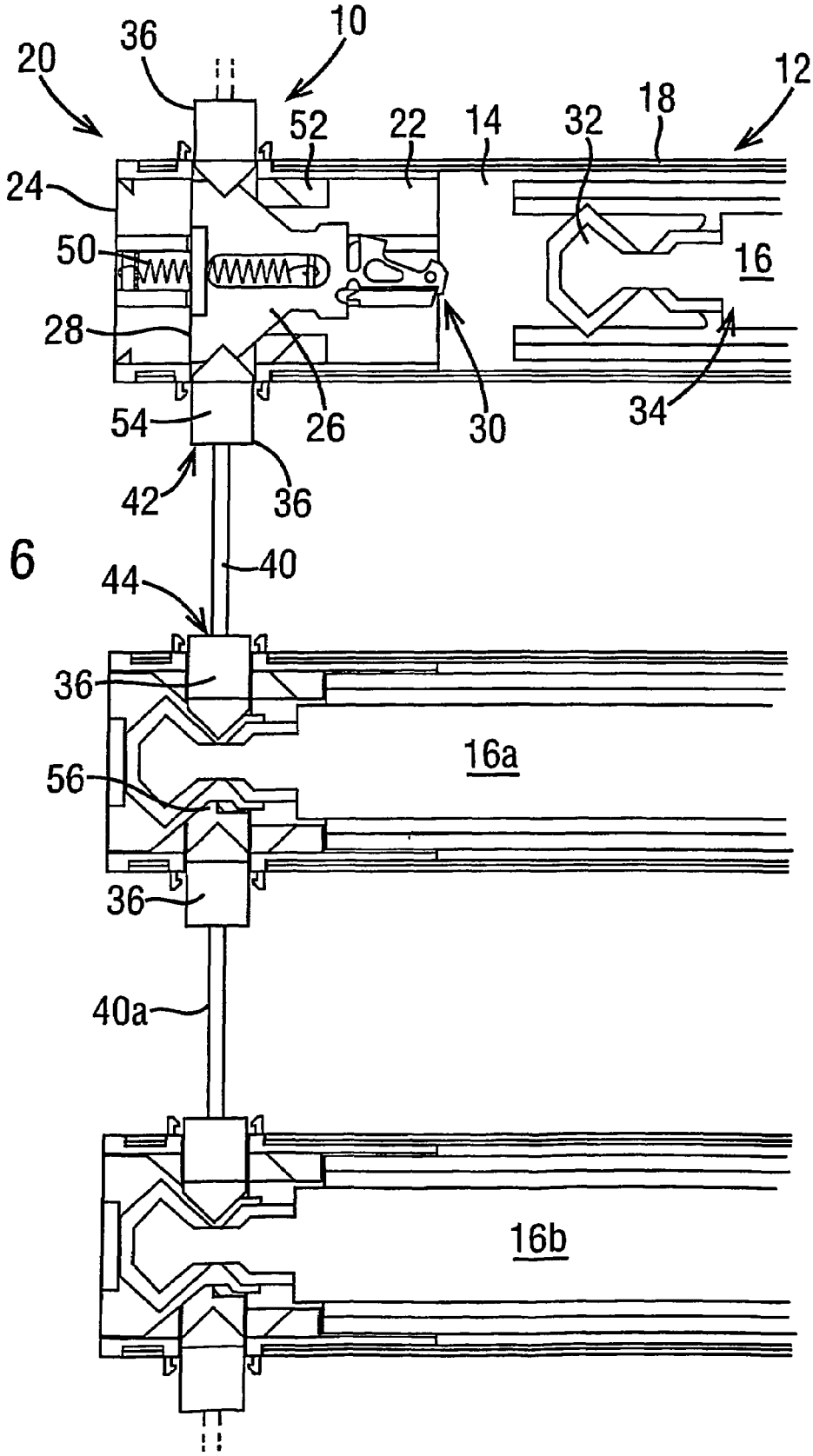
FIG. 6 is a partly schematic side elevation of three vertically arranged drawer slides, each comprising a drawer slide interlock assembly, with the top drawer slide in a partially extended configuration resulting from partial opening of a drawer to which it is fitted, and its plate in a latched, blocking position, thus preventing opening of the other two drawers.
Figure 7:
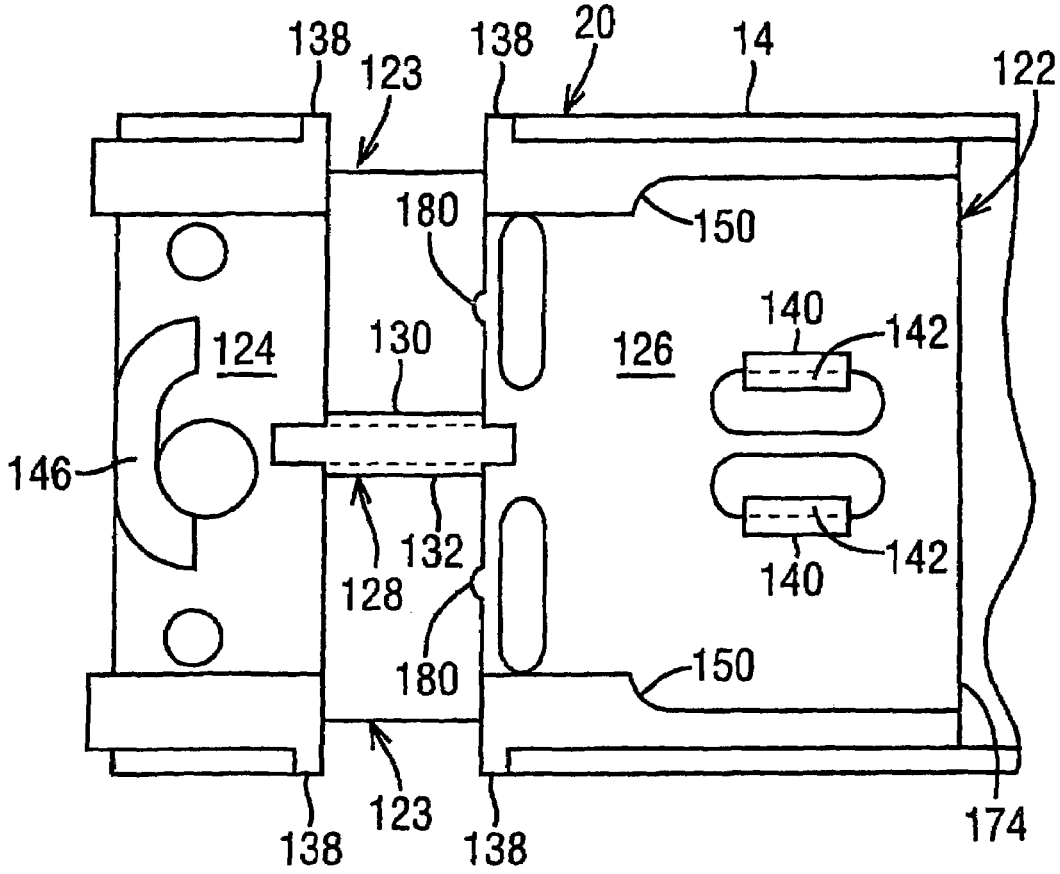
FIG. 7 is a plan view similar to FIG. 1 but of a housing of a second embodiment of the invention.

Two actuator followers (36) are slidably mounted in the outer slide member (14) for lateral movement at right angles to the movement of the inner slide member (16), the followers (36) having portions extending outwardly on the outer slide member (14), through apertures in the slide tracks of the outer slide member. The actuator followers (36) are mounted on opposite sides of and extend substantially perpendicularly to the longitudinal axis of the outer slide member (14), such that they face each other. The actuator followers of the embodiment shown in FIGS. 1 to 6 may be more clearly seen in FIG. 3, and are guided laterally by two parallel spaced guide walls provided by, respectively, a front wall of the rear part (23) of the housing (22) and a rear wall of the forward part (25). Each actuator follower is provided with means (54) by which it may be connected to an interlock rod (40, 40*a*), as shown in FIG. 6. Each follower (36) has an internal half width leg (56), and upstanding centrally therefrom, a turret (55). The half width legs 56 overlap with one another when the followers are mounted in the housing 20 (see FIG. 4), and extend beneath the rails (74) to hold the followers (36) in place. The turrets have an inwardly facing upper or first follower surface (46) and an inwardly facing lower or second follower surface (48) spaced laterally outwards from the surface (46). The two follower surfaces (46, 48) are inclined at an angle of about 45° to the longitudinal axis of the outer slide member (14). The upper or first follower surface (46) is substantially in the same plane as the actuator (32) whereas the lower or second follower surface (48) is mainly in the same plane as the plate (26).

At its rear end, a cut out (71) is provided in the intermediate slide member (18) to accommodate the front ends of the rails (74) and of the plate (26), leaving two prongs (72) which extend from the rear end of the intermediate slide member. These prongs locate against respective stops (52) moulded into the housing (22), when the intermediate slide member is moved to a closed position.

The drawer slide interlock assembly works as follows:

When a drawer (not shown) attached to the drawer slide is in a closed position, the drawer slide will be as shown in FIG. 4 and the interlock assembly is inoperative. When the drawer is opened, the inner slide member (16) is eventually moved away from the rear end (20) of the drawer slide, the stud (82) on the underside of the actuator (32) will engage the catching surface (85) of the recess (80), thus pulling the plate (26) away from the end (20) of the drawer slide. As the inner slide member and the plate (26) move forwardly, the upper or first follower surfaces (46) on each actuator follower will be engaged by the surfaces (58, 60) respectively of actuator (32), thus starting to move the followers (36) away from the central longitudinal axis of the drawer slide, so as to move the followers (36) laterally outwards.

Continued forward movement of the actuator (32) will then result in the lower or second follower cam surfaces (48) on the followers (36) becoming engaged respectively by the actuating surfaces (68, 70) on the plate (26), with the result that the followers are moved laterally outwards further. It is important that engagement of the follower surfaces occurs in the above described way, otherwise the resultant forces between the stud (82) and catching surface (85) may result in disengagement therebetween, or alternatively, the force on the line of weakness (81) may result in breakage at this point.

As the inner slide member continues to move away from the rear end (20) of the drawer slide, and the plate continues to slide along rails (74), the hook (76) will slide along the side of the upstand (78). When the hook reaches the forward end of the upstand (78), the hook will swing clockwise, due to the resilient connection (81) of the nose (79) to the rest of the plate (26), and wrap round the end of upstand (78), and act as a latch which prevents the plate (26) from sliding back towards the end (20) of the drawer slide under the action of the spring (50). Plate (26) is prevented from moving further away from the end of the drawer slide by stop (84), which abuts the end of the upstand (78). The clockwise swinging of the nose (79) disengages the hook (76) from the stud (82), thus allowing the inner slide member to continue moving away from the rear of the drawer slide and pass through the intermediate slide member (18). This configuration is shown in FIG. 5, where the drawer slide is in a partly extended configuration, with the drawer (not shown) partially open.

Referring now to FIG. 6, each drawer slide interlock assembly is connected to its adjacent assembly by a connecting rod (40 and 40*a*), the arrangement being such that one end of each connecting rod (40) is connected to the means (54), e.g. inserted into an aperture in an actuator follower (36) of one drawer slide interlock assembly and a second end (44) of the connecting rod (54) is inserted into an equivalent means (54) on an actuator follower (36) of the adjacent assembly.

This means that, when the upper drawer is open, it is not possible to open either of the drawers (not shown) attached to the middle or bottom drawer slide interlock assemblies. The inner slide member of the middle drawer slide is prevented from moving because the top actuator follower (36) of the middle drawer slide interlock assembly is not able to move from its blocking position, as the actuator follower at the other end of the connecting rod (40) to which it is attached is prevented from moving by the presence of edge (96) of plate (26). Similarly, the bottom drawer cannot be opened because the inner slide member of the bottom drawer slide is prevented from moving because the top actuator follower (36) of the bottom drawer slide interlock assembly is not able to move from its blocking position as the actuator follower (36) at the other end of the connecting rod (40*a*) to which it is attached is prevented from moving by the interaction between the legs (56) of the actuator followers of the middle drawer slide interlock assembly which, as described above, are unable to move due to the presence of edge (96) of plate (26) blocking the movement of the bottom actuator follower (36) of the top drawer slide. In this way, opening one drawer in a set of vertically arranged drawers causes the blocking of the movement of the inner slide member of the other drawer slides. Although not shown here, a similar effect may be achieved with all the drawers in a set of vertically arranged closed drawers by operating a lock to force down or up the highest or lowest actuator follower (36), respectively, in the set of drawer slide interlock assemblies, in order to lock the drawers in a closed position, as described subsequently herein.

Figure 8:
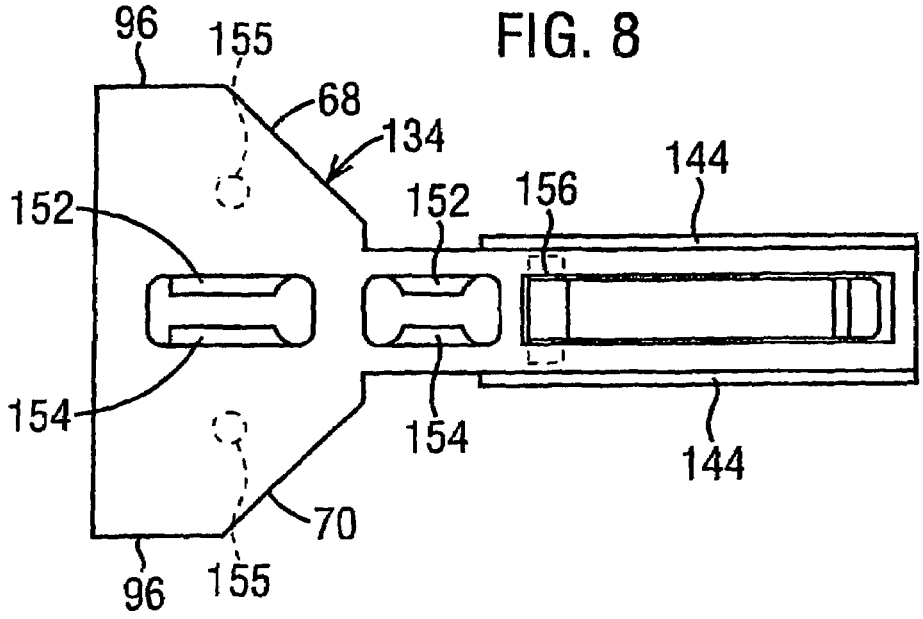
FIG. 8 is a plan view of a plate and catching means for the second embodiment.
Figure 9:
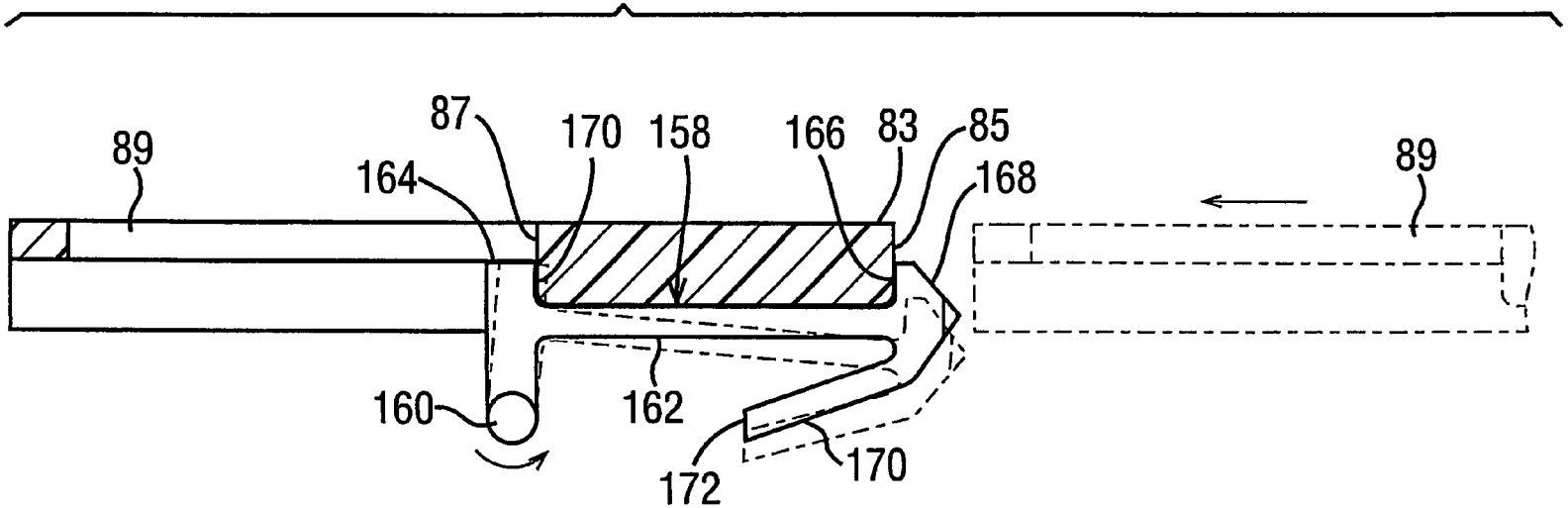
FIG. 9 is a side view of the catching means removed from the plate.
Figure 11:
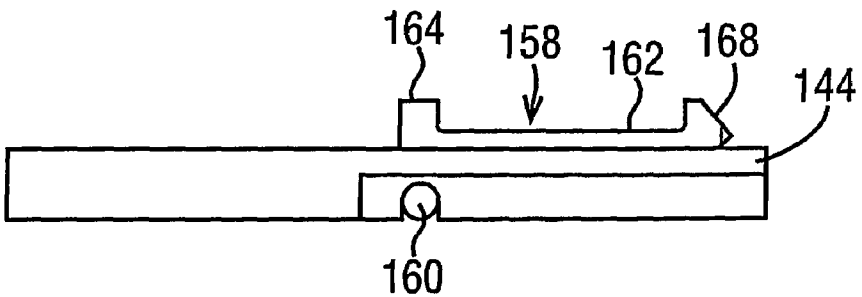
FIG. 11 is a side view corresponding to FIG. 8.
Figure 10:
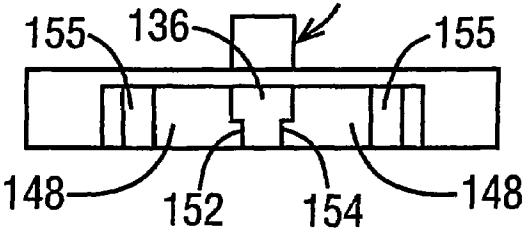
FIG. 10 is an end view of the plate of FIG. 8.
Figure 12:
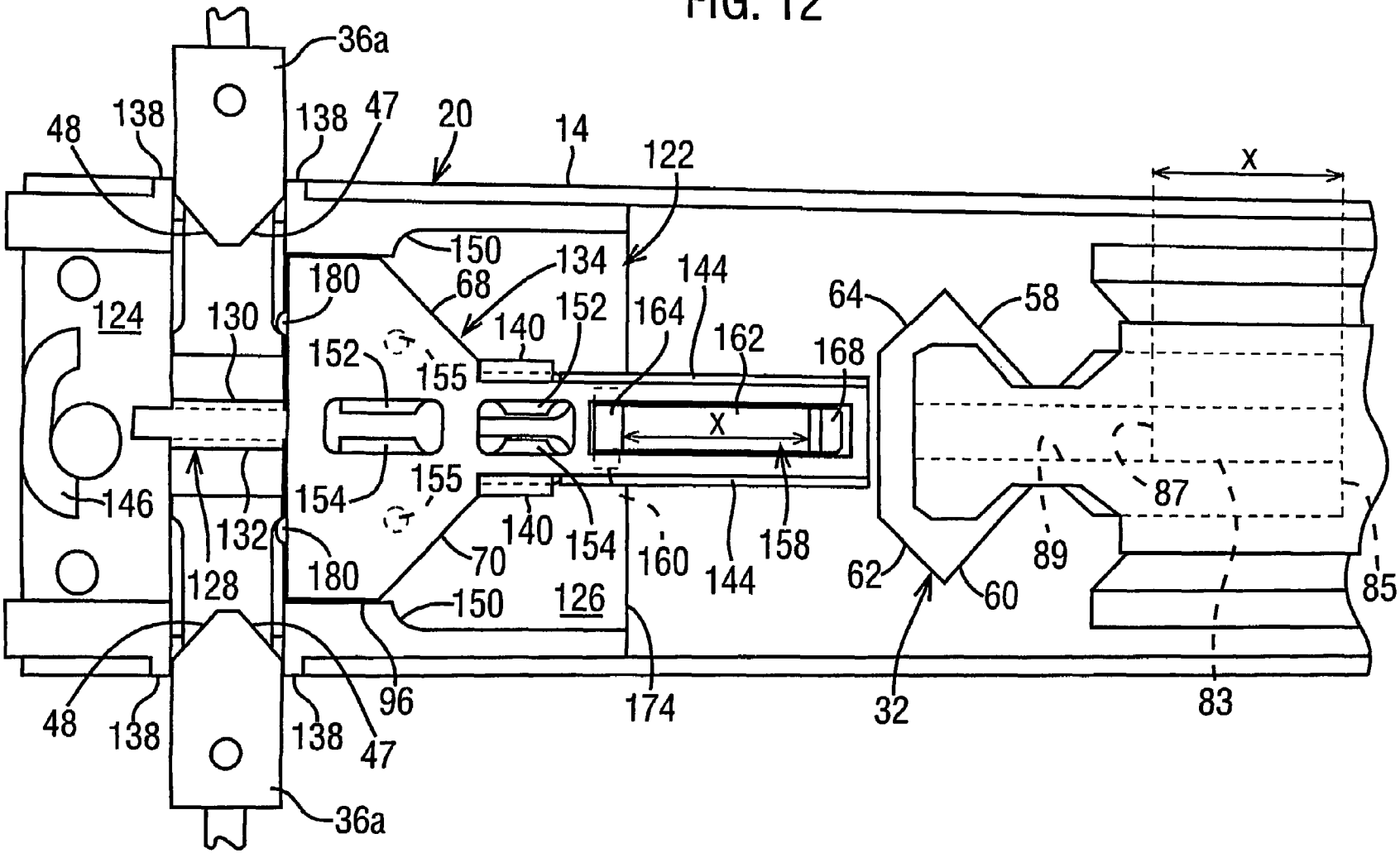
FIG. 12 is a plan view showing the plate and catching means mounted on the housing of FIG. 7.
Figure 13:
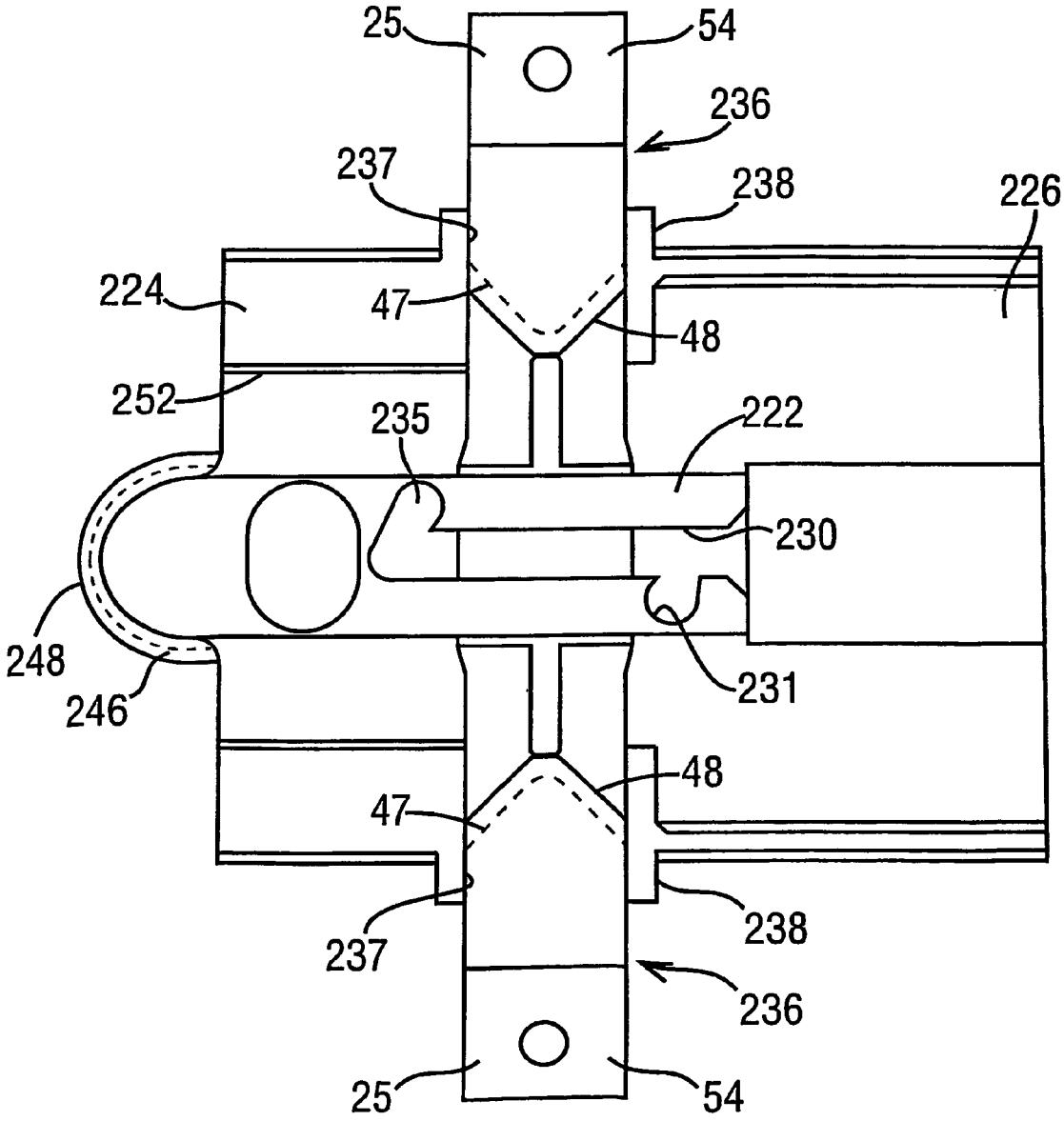
FIG. 13 is a plan view of a housing of an third embodiment of the invention.
Figure 14:
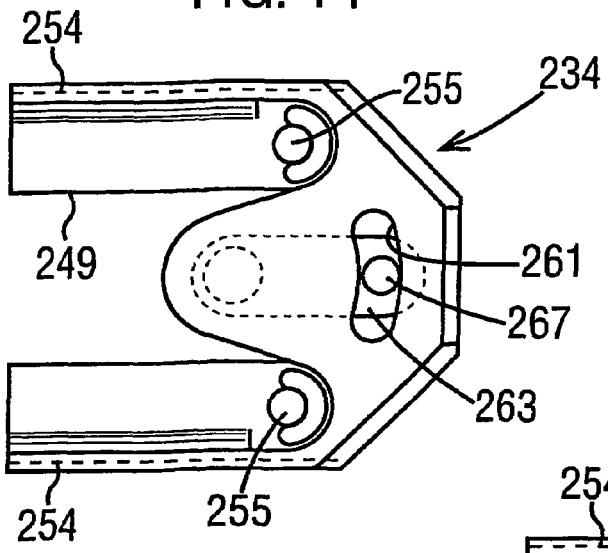
FIG. 14 is a plan view of a plate and catching means for the third embodiment.
Figure 15:
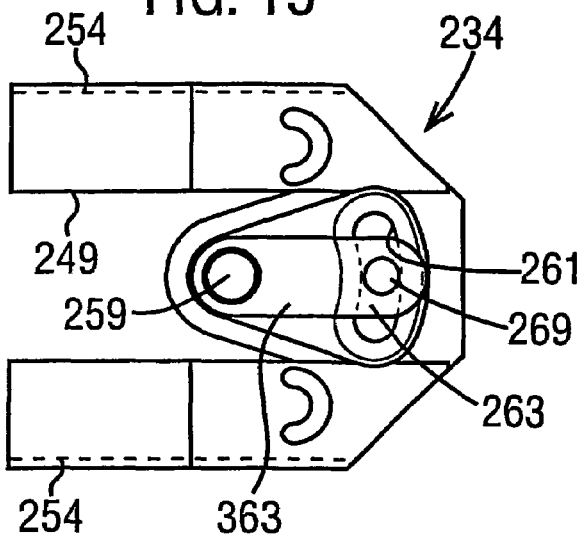
FIG. 15 is an underneath view of the plate and catching means.
Figure 16:
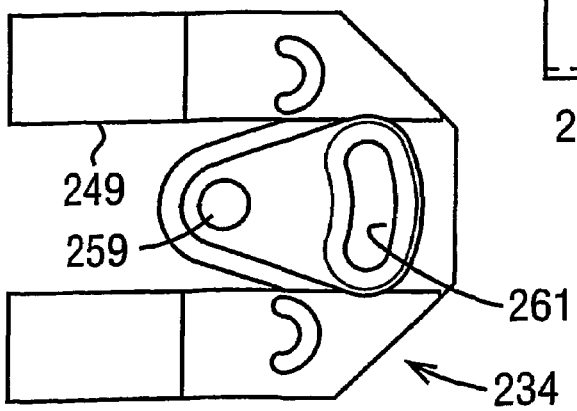
FIG. 16 is an underneath view of the plate, with the catching means removed.
Figure 17:
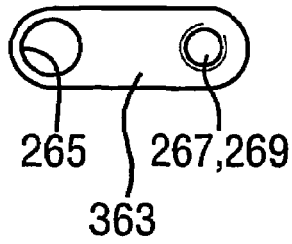
FIG. 17 is a plan view of the catching means.
Figure 18:
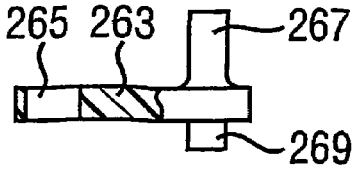
FIG. 18 is a side view of the catching means.

Referring now to FIGS. 7 to 12, which illustrate a second embodiment of the present invention, parts similar or identical to those of the first embodiment are identified by the same reference numerals. As in the previous embodiment, a housing (122) is fitted into a rear end of the outer slide member (14) which is provided with cut-outs (123) for this purpose. The housing is made of a polymeric material and comprises a rear part (124) spaced from a forward part (126) and joined thereto by a bridging member (128) incorporating two out-turned rails (130, 132) on which a delta-shaped plate 134) may be slidably located (see FIGS. 8 and 10 to 12). For this purpose, the plate (134) is provided at its rear end with a slide way (136) as illustrated in FIG. 10.

Outwardly projecting lugs (138) on the housing hold the housing in the openings (123) in the outer slide member (14), a similar arrangement to what is provided in the first embodiment described above. Towards the front end of the front portion (126) of the housing, upstanding guide posts (140) are provided, the guide posts having inturned portions (142) which act as forward guideways for the front end of the plate (134) which is provided with laterally extending slide surfaces (144) which locate beneath the portions (142) and between the posts (140). At its rear end, the housing (20) is provided with an upstanding arcuate buffer (146) against which a central nose on the underside of the plate (134) can engage to limit rearward movement of the plate (134) in the housing (20). Further arcuate buffers (150) are provided on an upstanding internal wall of the forward portion (126) of the plate to limit rearward movement of the intermediate slide member (18) of the drawer slide.

As can be seen, particularly from FIG. 8, the plate (134) is provided with two sets of inwardly turned guides (152, 154) which co-operate with the rails (130, 132) on the bridge (128) of the housing (120) to allow the plate (134) to slide in a controlled manner relative to the housing. A spring (not shown) extends between the buffer (146) on the housing (20) and the plate (134) to bias the plate towards the rear of the housing (20). Two anchoring points (155) are provided on the underside of the plate (134) to which the ends of the spring are connected. The spring is not essential, but preferred, not only to bias the plate (134) towards the rear of the housing (20) but also so as to provide a self closing feature for the drawer slide when it approaches its fully closed position (the spring (50) in the first embodiment provides a similar effect).

At its forward end, the plate (134), between the slide surfaces (144), is provided with a central aperture (156) to receive a catching means (158) seen in side elevation in FIG. 9. The catching means is pivotally connected to the plate (134) by means of two outwardly projecting pivots (160), one on either side thereof, which engage with a snap fit within mating pivot slots formed in the underside of the plate (134). The catching means (158) has a main spine (162) upstanding from a rear end of which is an abutment (164) and upstanding from a front end of which is a further abutment (166), a leading edge of which is chamfered (as shown at 168). This catching means is engageable with a centrally located depending block on the underside of the actuator (32), the length (X) of which corresponds to the spacing (X) between the abutments (164, 166). Projecting from the underside of the forward end of the catching means (158) is a resiliently deformable latching hook (170). When in its relaxed position, the free end (172) of the latching hook (170) will abut a forward end (174) of the housing (20) when the plate (134) together with the catching means (158) supported therein is pulled forwardly when a leading face (85) of the block (83) on the actuator (32) mounted in the inner drawer slide member (16) engages the face (166) on the catching means (158). When the faces (172 and 174) are abutting one another, side edges (96) of the plate (134) will be located in line with the recesses (123) in the outer slide member (14) as in the first embodiment of the invention, thus preventing actuator followers (36*a*) from moving inwardly towards a central longitudinal axis of the outer slide member (14). As with the first embodiment of the invention, the plate (134) is provided with forwardly facing actuating surfaces (68, 70) which engage with inwardly and rearwardly facing follower surfaces (48) on the followers (36*a*) when the plate (134) is pulled forwardly by forward movement of the inner slide member (16). This of course has the effect of moving the followers (36*a*) outwardly away from the longitudinally axis of the outer slide member (14).

As in the previous embodiment, each of the followers (36*a*) is connected in the manner shown in FIG. 6 by rods (40, 40*a*) to followers of adjacent slides so that if one drawer of a stack attached to an inner slide follower is opened, this will then make it impossible for the other drawers in the stack of drawers to be opened as described previously.

When it is desired to close the drawer, rearward movement of the inner slide member (16) will result in a groove (89) on the rear face of the actuator sliding over the abutments (164, 166) until a rear face (87) on the block (83) rides up over the chamfered surface (168) of the upstand (166), thus allowing the actuator (32) to move further rearwardly until the rear face (87) hits a forward facing surface (176) of the rear upstand (164) of the catching means. This will immediately cause the catching means (158) to pivot (anticlockwise as shown in FIG. 9) about its pivots (160), thus moving the free edge (172) of the latching hook (170) out of engagement with the front edge (174) on the housing, whereupon the spring (not shown) will immediately cause the plate (134) to move rearwardly in the housing (20) until prevented from moving any further by the upstanding buffer (146). This rearward movement will of course move the two lateral surfaces or side edges (96) of the plate (13) rearwardly, away from the recesses (123), thus allowing each of the followers (36) to move inwardly towards the longitudinal axis of the outer slide member (14), thus subsequently permitting another drawer in the stack of drawers to be opened. It will thus be appreciated that the interlock assembly shown in FIG. 7 to 12 operates in a similar manner to that shown in FIGS. 1 to 6 although the latching arrangement for holding the plate (134) in its forward interlocking position operates in a different manner from that shown in FIGS. 1 to 5.

Referring now to the third embodiment of the invention illustrated in FIGS. 13 to 21, the interlock assembly includes a housing (222) which fits into the rear end of an outer slide member (14) which is provided with cut outs for the purpose, with a snap fit, as in the previous embodiments. The housing is made of a polymeric material and comprises a rear part (224) spaced from a forward part (226) which are joined together by a slide rail (228) for slidably supporting, for fore and aft movement, a generally U-shaped plate (234). The slide rail (228) terminates at its rear end in an upstanding buffer (246), on an outer arcuate face (248) of which an arcuate groove is formed to accommodate a central portion of a spring (250). The slide rail (228) has a central slideway (230) therein towards a front end of which there is a latching recess (231) and at the rear end of which there is a recycling recess (235). As in the previous embodiments, a pair of actuator followers (236) is slidable supported in slide channels (237) in the housing (224) for sliding movement at right angles to the longitudinal axis of the outer slide member (14). Although the actuator followers are shown as being slidably supported in slide channels (237) formed in the housing (222), it will be appreciated that the actuator followers could be supported in some other way for sliding movement at right angles to the longitudinal axis of the outer slide member, not only in this embodiment but also in the previously described embodiments. As in the previous embodiments, the actuator followers are provided with follower surfaces (47 and 48), and with means (54) for connection to interlock rods (40 and 40A). Outwardly projecting lugs (238) hold the housing (222) firmly in the outer slide member (14), as in the previous embodiments.

As can be seen from FIGS. 14 to 18 in particular, the plate (234) can slide back and forth on the housing (222) and has a central slideway (249) running throughout its length which engages the slide rail (228) to guide the plate in its fore and aft sliding movement. Projecting upwardly from an upper face of the plate is a pair of anchoring pegs (255) to which respective ends of the spring (250) are attached. This ensures that at all times the plate is biased towards to its rearmost position in the housing, as shown in FIG. 19. Down each outer side edge of the plate is a longitudinally extending guideway (254) which engages with an inwardly projecting guide rib (252) on an internal wall of the housing (222) so as to ensure linear sliding movement of the plate relative to the housing. A recess (257) is formed in the underside of the plate (234) having a depending pivot pin (259) at one end and an arcuate slot (261) adjacent an opposite end thereof. A catching means in the form of a pivoting arm (263) is loosely supported within the recess (257), the pivoting arm having adjacent one end thereof an aperture (265) therein which forms a close fit on the pivot pin (259) and having at its upper end a catch pin (267) which forms a sliding fit in the arcuate slot (261). The catch pin (267) projects upwardly through the slot (261) by a sufficient distance to enable it to be engaged by an actuator (232) secured to the rear end of the inner slide member (16). Also extending downwardly from the pivoting arm (263) is a depending guide pin (269) which is coaxial with the catch pin (267) and forms a sliding fit in the slideway (230) in the housing (222).

Referring now to FIGS. 19 to 21, the actuator (232) has three principal recesses on its underside, one on its trailing central region and two opening outwardly on either side towards the sides of the outer slide member (14). Each of the outwardly opening recesses is shaped to provide a pair of forwardly extending but inclined actuating surfaces (258, 260) which are designed to cooperate with respective ones of the follower surfaces (48) on the actuator followers (36). Furthermore, the trailing or rear end of the actuator (232) is also formed with inclined surfaces (62, 64) as in the previous embodiments which cooperate with the follower surfaces or recess surfaces (47) on the follower (36). Supplementary recesses (201) are also formed in the underside of the actuator (232) to make certain that when the actuator is in its rearmost position, its underside does not foul the tip of the upstanding spring anchoring pegs (255).

Between the inclined surfaces (62 and 64) the central recess identified at 203 in FIGS. 19 to 21, has a depending generally centrally located island block (205) therein spaced from the opposed specially shaped side walls (207 and 209) of the recess by a distance sufficient to accommodate with an easy sliding fit the upstanding end of the catch pin (267). The island block (205) has a leading inclined pin pulling surface (211) which merges with a less sharply inclined pin camming surface (213) at one end thereof, the opposite end thereof merging with a fore and aft extending surface (215) parallel to but spaced from the side wall (209). At its trailing end, the island block (205) has an inclined recycling surface (217) extending generally parallel to the surface (213) which then merges with an arcuate side wall surface (219) which is generally parallel to but spaced from the arcuate side wall (207) defining the recess (203), so as to provide a recycling channel (221) which is just sufficiently wide to accommodate the projecting tip of the catch pin (267). Between the parallel side walls (209 and 215) on the other side of the island block, there is a fore and aft extending channel for the catch pin (267) and opposite the latch actuation surface (213) there is a pin unlatching surface (223) designed to move the catch pin (267) out of the latching recess (231) formed in the slide way (230).

The mechanism operates as follows:

When the drawer to which the inner slide member (16) is attached is in its closed position, the actuator (232) will be in its FIG. 19 position and the plate (234) will be in its rearmost position in the housing (222). When in this position, the catch pin (267) will be centrally located between an arcuate forward end (225) of the recess (203) and the rearwardly extending inclined pin pulling surface (211) of the island block (205). Forward movement of the drawer to open the drawer will cause the pin pulling surface (211) to engage the rear of the catch pin (267). The pin pulling surface (211) is slightly inclined, thus tending to bias the pin and hence the pivoting arm (263) to which it is engaged to move downwardly as shown in the figures but because there is a further depending guide pin (269) on the pivoting arm (263) which is engaged in the slide way (230), the two pins and the pivoting arm (263) have to remain in a central position. Accordingly, continued movement of the inner slide member (16) as a result of further opening of the drawer to which it is connected will result in the plate in which the pivoting arm is pivotally supported to move forwardly against the bias of the spring (250) towards the front end of the slide way (230). However, as the plate (234) nears the front of the slide way (231), the presence of the latching recess (231) allows the downward biasing force on the catch pin (267) to move the depending guide pin (269) downwardly into the latching recess (231), this downward movement being completed by the inclined latch actuation surface (213) as the inner slide member (16) moves further forwardly. Once the depending guide pin has been forced wholly into the latching recess (231) by the latch actuation surface (213), it will be held within the latch recess (231) because the rearmost side wall of the latching recess (231) is slightly inclined as shown at 202. Once the depending guide pin is latched within the latching recess (231), it will then be located wholly within the fore and aft extending passageway defined by the side walls (209 and 215), thus allowing the inner slide member (16) and the drawer to which it is attached to be fully opened since the pin (267) can escape from the rearmost end of the aperture (203). This configuration is clearly illustrated in FIG. 21, whereas FIG. 20 shows the mechanism in an intermediate position between the positions of FIGS. 19 and 21.

Forward movement of the plate (234) as a result of opening of the drawer to which the inner slide member (16) is attached will cause inclined forwardly facing actuating surfaces (68 and 70) on the plate (234) or the forwardly facing actuating surfaces (258 and 60) on the actuator to move into engagement with the follower or reset surfaces (248) on the follower (36) so as to move the followers outwardly away from the longitudinal central axis of the outer slide member (14). This will then allow the plate (234) to move freely forwardly as a result of further opening of the drawer to which the inner slide member (16) is attached so that two opposed side edges (296) of the plate then prevent inward movement of the actuator followers (36).

Of course, once the actuator followers (36) are held in their outermost blocked position, as described above, rods attached at one end to the actuator followers (36) and connected at their other ends to actuator followers of adjacent drawer slides fitted with identical mechanisms will block the forward movement of the respective plate (234), thus preventing the adjacent drawers from being opened, as in the previous embodiments.

When it is desired to close the drawer so as to move the mechanism from the FIG. 21 position, rearward movement of the drawer will eventually cause the actuator (232) attached to the inner slide member (16) of the drawer to move to a position wherein the mouth of the aperture (203) will overlie the open end of the slide way (230). Because the catch pin (267) is latched within the recess (232), the fore and aft extending passageway defined by the side walls (209 and 215) will move over the projecting tip of the catch pin (267) until eventually the unlatching surface (223) engages the tip of the pin (267) and, acting as a cam, starts to lift the pin out of the latching recess (231). Continued rearward movement of the actuator will lift the catch pin totally out of the recess (231) and the latch pin will be caused to move between the arcuate forward end (225) of the wall of the recess (203) and the pin pulling surface (211). Once the pin is in this position, the spring (250) will bias the plate and hence the actuator which is now engaged with the plate by virtue of the presence of the pin (267) engaging the surface (225) towards the rear of the outer side member (14) thus acting as a self-closing mechanism for the drawer. Of course, as the plate (234) moves back to its rearmost position, as illustrated in FIG. 19, so the side edges (296) thereof will move to the rear of the slide channels (237) thus allowing the actuator followers (36) to move inwardly towards the longitudinal central axis of the outer slide member. In other words, should a user wish to open an adjacent drawer of the stack of drawers, this will be possible since the interlock mechanism of the drawer to be opened will be allowed to operate so as to move one or other of the actuator followers (36) into a plate blocking position as shown in FIG. 19.

In some instances, it is possible for the catch pin (267) to become inadvertently disengaged from the latching recess (231) even when the drawer is fully opened and the actuator (232) is nowhere near the housing (222) let alone the slide way (230). When such unlatching of the catch pin occurs, the spring (250) will of course immediately return the plate (234) together with the catch pin and its pivoting arm back to the FIG. 19 position. In that event, subsequent closing of the drawer will eventually result in the inclined recycling surface (217) on the trailing edge of the island block (205) coming into engagement with the catch pin (267). Such engagement will result in the catch pin (267) being cammed by the inclined surface (217) upwardly into the recycling recess (235). When this occurs, the pin can then pass down the channel (221) as a result of further rearward movement of the actuator (232) until the pin moves into the inwardly inclined region of the passageway (221) whereupon it will be cammed back to a central location in the middle of the slide way (230) by virtue of a camming surface (227) forming part of the arcuate forward end (225) of the recess (203). Once the catch pin (267) is centrally located in the slide way (230), it will be located behind the pin pulling surface (211) thus allowing the mechanism to operate as previously described. This moving aside of the catch pin to allow the passage of the island block (203) is known as recycling. Such recycling is also possible in each of the previously described embodiments.

In each of the embodiments described herein, two further inclined surfaces (62 and 64) are provided on the actuator (32) on the rear end thereof which co-operate respectively with inclined reset surfaces (47) on the followers (36, **36*a*). This means that, when the actuator (32**) is returned to the rear of the drawer slide on closing a drawer to which the drawer slide is fitted, the two followers will be moved to a non-blocking position spaced from the longitudinal axis of the drawer slide, should they inadvertently have moved to a plate blocking position.

It will be appreciated that, in the second embodiment of FIGS. 7 to 12, the actuator followers (**36*a*) may be provided with two sets of follower surfaces (46, 48) as in the first embodiment of the invention. Also, in the second embodiment, small projections (180) extend onto the space between the rear part (124) and forward part (126) of the housing, which co-operate with projections (not shown) on the followers (36*a*). This allows the followers to be fitted by forcing the projections thereon past the projections (180**) with a "snap-fit" action.

It is envisaged that at its rear end, the housing (20) may be fitted with a cantilevered, forwardly extending plate which will overlie the actuator when it is located at the rear of the drawer slide, to prevent lateral play of the actuator, and hence of the closed drawer to which it is fitted.

It is also envisaged that the rear part (24, 124) of the housing need not be supported by the outer slide member (14).

It will be apparent to those skilled in the art that some of the features described with reference to the first embodiment of the invention could be used on one or both of the second and third embodiments of the invention, and vice versa.

The interlocking assemblies described herein can also easily be provided with a locking capability by interfacing with a separate locking system or mechanism. For example, a locking system may comprise a member which blocks the upward displacement of the actuator followers, thereby preventing any of the slide members from opening. This can be accomplished by using a lock member which can slide in front of the travel path of a rod connected to the upper actuator follower of the uppermost slide member.

It will of course be understood that the present invention has been described above purely by way of example, and modifications of detail can be made within the scope of the invention.

The invention claimed is:

1. A drawer slide interlock assembly for a drawer cabinet comprising a set of vertically arranged drawers mounted in a frame by spaced drawer slides each having an outer slide member and an inner slide member slidable relative to one another, the outer slide member being adapted for mounting on the frame and the inner slide member being adapted for mounting on a respective one of the drawers, said interlock assembly located at the rear of each drawer slide on at least one side of the set of drawers, said interlock assembly comprising:

a housing;

a plate slidably movable within the housing between a first position and a blocking position;

an actuator mounted on the rear of the inner slide member;

cooperating attachments on the plate and on the actuator enabling the plate to be selectively engaged by the actuator to move the plate to its blocking position during an operation of opening the drawer to which the inner slide member is connected;

a catch that maintains the plate in the blocking position;

an actuator follower supported for movement relative to the outer slide member between a plate blocking position and a blocked position, the actuator follower having a first follower surface arranged for selective contact by an actuating surface on the actuator and a second follower surface arranged for selective contact by an actuating surface on the plate, wherein, when the drawer is opened, at least one of the first follower surface is contacted by the actuating surface on the actuator and the second follower surface is contacted by the actuating surface on the plate to move the actuator follower from the plate blocking position to the blocked position, said actuator follower subsequently being maintained in said blocked position while the drawer is open by the plate in the plate's blocking position, and wherein closing of the drawer causes the plate to be returned to its first position, and the actuator follower to be returned to the plate blocking position; and a rod connected to the actuator follower and adapted to connect to a second actuator follower of a second, substantially identical interlock assembly used on a second, adjacent drawer, wherein when the actuator follower is in the blocked position, the rod maintains the second actuator follower of the adjacent interlock assembly in a plate blocking position to maintain the plate of the second interlock assembly in its first position.

2. An interlock assembly according to claim 1, wherein the actuator surface on the actuator contacts the first follower surface to move the actuator follower outwardly away from the longitudinal central axis of the outer slide member.

3. An interlock assembly according to claim 2, wherein the actuator follower is maintained in its blocked position when the plate is held in its blocking position as a result of a latch op the plate moving to a latched position.

4. An interlock assembly according to claim 1, wherein the plate is slidably supported in a housing supported within a rear end of the outer slide member for movement towards and away from the rear of the outer slide member and wherein the blocking position is spaced therefrom, and wherein the catch is provided between the housing and the plate.

5. An interlock assembly according to claim 4 and further comprising spring means biasing the plate towards the rear of the housing, and wherein the catch extends between the housing and the plate to hold the plate in its blocking position spaced from the rear of the housing, the cooperating members being arranged to move the plate from the rear of the housing to its blocking position when the inner drawer slide member is initially moved from its rearmost position when the drawer to which it is fitted is opened but being arranged tar release the plate when the plate is in its blocking position to allow the drawer fully to open, said release occurring once the catch is in a latched position, the arrangement being such that when the drawer is moved towards a dosed position and the actuator moves into the vicinity of the latched plate, the catch is released allowing the plate to move under its spring bias to the rear of the housing.

6. An interlock assembly according to claim 4, wherein the housing is divided into a rear pan and a forward part spaced from the rear part and wherein the rear part is connected to the forward part by at least one slide rail extending generally parallel to the longitudinal axis of the outer slide member.

7. An interlock assembly according to claim 6, wherein a slideway is provided on the underside of the plate and engages the or each slide rail.

8. An interlock assembly according to claim 6, in which a front edge of the rear part of the housing is parallel with a rear edge of the front part of the housing, said two edges providing guide walls for the actuator follower.

9. An interlock assembly according to claim 6, wherein two rails extend the full length of the housing and wherein the catch comprises an upstand at a forward end of one of the rails and a latching nose on a forward end of the plate.

10. An interlock assembly according to claim 9, wherein a front end of the plate has the latching nose and a portion of the cooperating members supported thereon, the latching nose being connected to the remainder of the plate by a thin section of plastics material acting as a pivot to allow the nose to pivot about an axis extending at right-angles to the plane of the plate.

11. An interlock assembly according to claim 10, wherein the nose has a hook on a rear face thereof which co-operates with a leading edge on the upstand to provide the catch.

12. An interlock assembly according to claim 11, wherein a rear face of the upstand cooperates with a stop on the plate to limit movement of the plate away from a rear end of the drawer slide.

13. An interlock assembly according to claim 9, wherein tire cooperating members comprise a stud on a rear face of the actuator which cooperates with a catching surface in a recess in the nose, the nose having a position of rest in which the hook is in a position to engage the forward end of the upstand and the arrangement being such that, when the actuator moves towards the rear of the outer drawer slide member so as to overlie the plate, the stud will engage with a release surface opposite the catching surface to cause the nose to pivot in a direction so as to release the hook from the forward end of the upstand thus allowing the plate to move under its spring bias towards the rear of the outer drawer slide member until the side surface of the plate will no longer prevent the actuator follower from moving towards the longitudinal central axis of the slide member.

14. An interlock assembly according to claim 6, wherein the rear part of the housing is connected to the forward part of the housing by a bridging member incorporating two outwardly turned rails with which a rear portion of the plate engages, there being upstanding guide posts located on a forward end of the forward part of the housing which act as guide means for a forward end of the plate.

15. An interlock assembly according to claim 14, wherein the forward end of the plate is provided with laterally extending slide surfaces which engage beneath inturned guides on the upstanding guide posts.

16. An interlock assembly according to claim 14, wherein the cooperating members comprise a central aperture provided in the forward end of the plate receiving a first part of the cooperating members.

17. An interlock assembly according to claim 16, wherein the first part of the cooperating members is pivotally supported within the aperture by means of a pair of outwardly projecting pivots which engage within the mating pint slots in the underside of the plate.

18. An interlock assembly according to claim 17, wherein the first part of the cooperating members comprises a main spine which locates wholly within the aperture, the spine having upstanding from its rear end an abutment and upstanding from its front end a further abutment having a chamfered leading edge, there being a resiliently deformable latching hook extending from the underside thereof.

19. An interlock assembly according to claim 18, wherein a groove is formed on the rear face of the actuator which terminates in a depending block comprising a second part of the cooperating members and sized to fit between the abutment and the further abutment, a rear face of the block being engageable with a forward face of the abutment and a front face of the block being engageable with a rear face of the further abutment, the arrangement being such that, as the actuator moves forwardly from a rear end of the outer drawer slide, the block will engage the rear face, thus drawing the plate against its spring bias towards a front end of the housing until a trailing end of the latching hook engages with a front edge of the forward part of the housing, whereupon the block will disengage from the first part of the cooperating members to allow the drawer to open fully, and the arrangement being such that, when the drawer is moved rearwardly, the rear face of the block will ride over the chamfered leading edge of the further abutment, allowing the actuator ti move rearwardly until the block engages the forward face on the abutment, this causing the first part of the cooperating members to pivot so as to disengage the hook from the front edge of the housing, allowing the block to engage between the abutment and the further abutment, and thereby allowing the plate to move under its spring bias towards the rear end of the slide member.

20. An interlock assembly according to claim 14, wherein the spring bias is provided by a coil spring extending between a buffer at the rear of the housing and two spaced anchoring points on the underside of the plate.

21. An interlock assembly according to claim 4, wherein a single slide rail joins together the front and rear parts of the housing and a central slide way is formed in said slide rail having at a rear end thereof a recycling recess and adjacent a front end thereof a latching recess.

22. An interlock assembly according to claim 21, wherein the plate has a central slide way on its underside which engages with the slide rail and wherein, within the central side way, a recess is provided at one end with a pivot pin and at its opposite end with an arcuate slot whereby a pivoting arm having an aperture in one end thereof and a catch pin at the other end thereof is pivotally supported in the recess with the aperture surrounding the pivot pin and the catch pin sliding in the arcuate slot and projecting upwardly therefrom.

23. An interlock assembly according to claim 22, wherein a depending guide pin is provided on the underside of the pivot arm for sliding engagement in the slide way in the slide rail on the housing.

24. An interlock assembly according to claim 21, wherein the actuator has on its underside three principal recesses therein, two of which open laterally outwards and are partly defined by forwardly facing actuating surfaces designed to Cooperate with follower surfaces on the actuator followers and the third of which is located between two rearwardly facing inclined surfaces designed to cooperate with forwardly facing inclined follower surfaces on the actuator followers.

25. An interlock assembly according to claim 24, wherein the third recess extends generally fore and aft within the underside of the actuator and has a downwardly depending island block therein spaced from the walls of the recess to define a fore and aft extending linear channel on the side of the block and a recycling channel on the Other side, the fore and aft extending channel and the recycling channel being interconnected at a forward end of the recess by an arcuate wall of the recess, part of which defines an unlatching surface for the catch pin and another part of which forms a recycling camming surface for the catch pin.

26. An interlock assembly according to claim 25, wherein at its forward end, the island block has an inclined pin pulling surface which merges with a front end of a latch actuation surface, the rear end of which merges with the fore and aft extending passageway.

27. An interlock assembly according to claim 25, wherein a rearwardly facing recycling surface is provided on the depending island block for moving the catch pin upwardly into the recycling recess in the slide way.

28. An interlock assembly according to claim 1, wherein when the plate is in its blocking position, a side surface of the plate contacts the second follower surface of the actuation follower to prevent the actuator follower from moving back towards its plate blocking position, thus maintaining the actuator follower of the adjacent drawer slide interlock assembly of the adjacent drawer in such a position that it will prevent movement of the plate of the adjacent mechanism from moving to its blocking position, thereby preventing opening of the second drawer.

29. An interlock assembly according to claim 28, wherein the plate is delta-shaped with a forward projecting nose.

30. An interlock assembly according to claim 29, wherein the leading edges of the delta-shape comprise the actuating surface on the plate.

31. An interlock assembly according to claim 29, wherein the catch comprises the projecting nose.

32. An interlock assembly according to claim 1, wherein the actuator has a further inclined surface on its trailing edge, relative to its forward movement, for cooperation with an inclined reset surface on the actuator follower.

33. An interlock assembly according to claim 1, said interlock assembly incorporating therein a self close mechanism for the drawer slide.

34. An interlock assembly according to claim 33, wherein the self close mechanism comprises a spring extending between a housing of the interlock assembly and a plate movably supported in the housing and which plate is connected to the inner slide member of the drawer slide by latching means forming part of the interlock assembly when the inner slide member is adjacent the rear of the drawer slide.

35. An interlock assembly according to claim 33, wherein the plate is slidably supported in the housing between a first position at the rear of the housing and a blocking position spaced therefrom, the spring biasing the plate towards the first position at the rear of the housing.

36. A stack of drawers arranged vertically in a cabinet, each drawer being mounted in a frame by spaced drawer slides each having an outer slide member and an inner slide member slidable relative to one another, the outer slide member being adapted for mounting on the frame and the inner slide member being adapted for mounting on a respective one of the drawers, and each drawer being provided with an interlock assembly located at the rear of each drawer slide on at least one side of the stack of drawers, the interlock assembly comprising:

a housing;

a plate slidably movable within the housing between a first position and a blocking position;

an actuator mounted on the rear of the inner slide member;

cooperating attachments on the plate and on the actuator enabling the plate to be selectively engaged by the actuator to move the plate to its blocking position during an operation of opening the drawer to which the inner slide member is connected;

a catch that maintains the plate in the blocking position;

an actuator follower supported for movement relative to the outer slide member between a plate blocking position and a blocked position, the actuator follower having a first follower surface arranged for selective contact by an actuating surface on the actuator and a second follower surface arranged for selective contact by an actuating surface on the plate, wherein, when the drawer is opened, at least one of the first follower surface is contacted by the actuating surface on the actuator and the second follower surface is contacted by the actuating surface on the plate to move the actuator follower from the plate blocking position to the blocked position, said actuator follower subsequently being maintained in said blocked position while the drawer is open by the plate in the plate's blocking position, and wherein closing of the drawer causes the plate to be returned to its first position, and the actuator follower to be returned to the plate blocking position; and a rod connected to the actuator follower and adapted to connect to a second actuator follower of a second, substantially identical interlock assembly used on a second, adjacent drawer, wherein when the actuator follower is in the blocked position, the rod maintains the second actuator follower of the adjacent interlock assembly in a plate blocking position to maintain the plate of the second interlock assembly in its first position, wherein the rod is located adjacent the rear of the cabinet.

37. A method of preventing a stack of drawers supported in a cabinet from toppling over as a result of more than one drawer being opened at any one time, each drawer in the stack being mounted in a frame by spaced drawer slides each having an outer slide member and an inner slide member slidable relative to one another, the outer slide member being adapted for mounting on the frame and the inner slide member being adapted for mounting on a respective one of the drawers, the method comprising fitting each drawer in the stack with a drawer slide interlock assembly comprising:

a housing;

a plate slidably movable within the housing between a first position and a blocking position;

an actuator mounted on the rear of the inner slide member;

cooperating attachments on the plate and on the actuator enabling the plate to be selectively engaged by the actuator to move the plate to its blocking position during an operation of opening the drawer to which the inner slide member is connected;

a catch that maintains the plate in the blocking position;

an actuator follower supported for movement relative to the outer slide member between a plate blocking position and a blocked position, the actuator follower having a first follower surface arranged for selective contact by an actuating surface on the actuator and a second follower surface arranged for selective contact by an actuating surface on the plate, wherein, when the drawer is opened, at least one of the first follower surface is contacted by the actuating surface on the actuator and the second follower surface is contacted by the actuating surface on the plate to move the actuator follower from the plate blocking position to the blocked position, said actuator follower subsequently being maintained in said blocked position while the drawer is open by the plate in the plate's blocking position, and wherein closing of the drawer causes the plate to be returned to its first position, and the actuator follower to be returned to the plate blocking position; and a rod connected to the actuator follower and adapted to connect to a second actuator follower of a second, substantially identical interlock assembly used on a second, adjacent drawer, wherein when the actuator follower is in the blocked position, the rod maintains the second actuator follower of the adjacent interlock assembly in a plate blocking position to maintain the plate of the second interlock assembly in its first position, whereby when a first one of the drawers in the stack is opened, the interlock assembly of the first drawer will prevent the other drawers from being opened until the first drawer is moved to a closed position.

* * * * *